United States Patent [19]

Harrington et al.

[11] 4,014,191

[45] Mar. 29, 1977

[54] COMBINATION LOCK

[76] Inventors: Richard P. Harrington; Russell J. Harrington, both of P.O. Box 474, Mountainburg, Ark. 72946

[22] Filed: Aug. 13, 1975

[21] Appl. No.: 604,450

Related U.S. Application Data

[63] Continuation-in-part of Ser. No. 479,164, June 13, 1974, abandoned.

[52] U.S. Cl. ..... 70/25; 70/129; 70/305; 70/316; 70/332

[51] Int. Cl.[2] ..... E05B 37/06

[58] Field of Search ..... 70/22, 24, 25, 27, 129, 70/286, 305, 316, 317, 318, 330, 332, 323, DIG. 28, DIG. 75

[56] References Cited

UNITED STATES PATENTS

| | | | |
|---|---|---|---|
| 1,308,521 | 7/1919 | Butter | 70/311 |
| 1,911,559 | 5/1933 | Dyson | 70/25 |
| 2,247,220 | 6/1941 | Conlon | 70/305 |
| 2,677,265 | 5/1954 | Bergendahl | 70/305 |
| 3,237,434 | 3/1966 | Jackes et al. | 70/305 X |

*Primary Examiner*—Ramon S. Britts
*Assistant Examiner*—William E. Lyddane
*Attorney, Agent, or Firm*—Jennings B. Thompson

[57] ABSTRACT

The combination lock disclosed has a plurality of disc-shaped tumblers mounted side-by-side for individual relative rotation around a common axis. A cylindrical member or drum having a plurality of lugs thereon is located adjacent the outer periphery of the tumblers for movement by a dial around the axis of rotation of the tumblers and for rotation on its longitudinal axis. A ratchet rotates the drum on its longitudinal axis a portion of a revolution each time the dial is returned to a selected position. Each tumbler has a protrusion on its periphery that when engaged by a lug on the drum will cause the tumbler to be rotated with the drum as the drum is moved around the axis of rotation of the tumbler by a dial. The lugs are arranged on the drum so that in one position of the drum the dial will move all of the tumblers to a preselected relative position. An audible or visible signal indicates that the lugs are in this position. Then, as the ratchet rotates the drum after each movement of the dial the tumblers will be moved in sequence to their preselected position in accordance with the combination to open the lock and allow a lock bolt to be opened through a lock bolt operating assembly.

24 Claims, 39 Drawing Figures

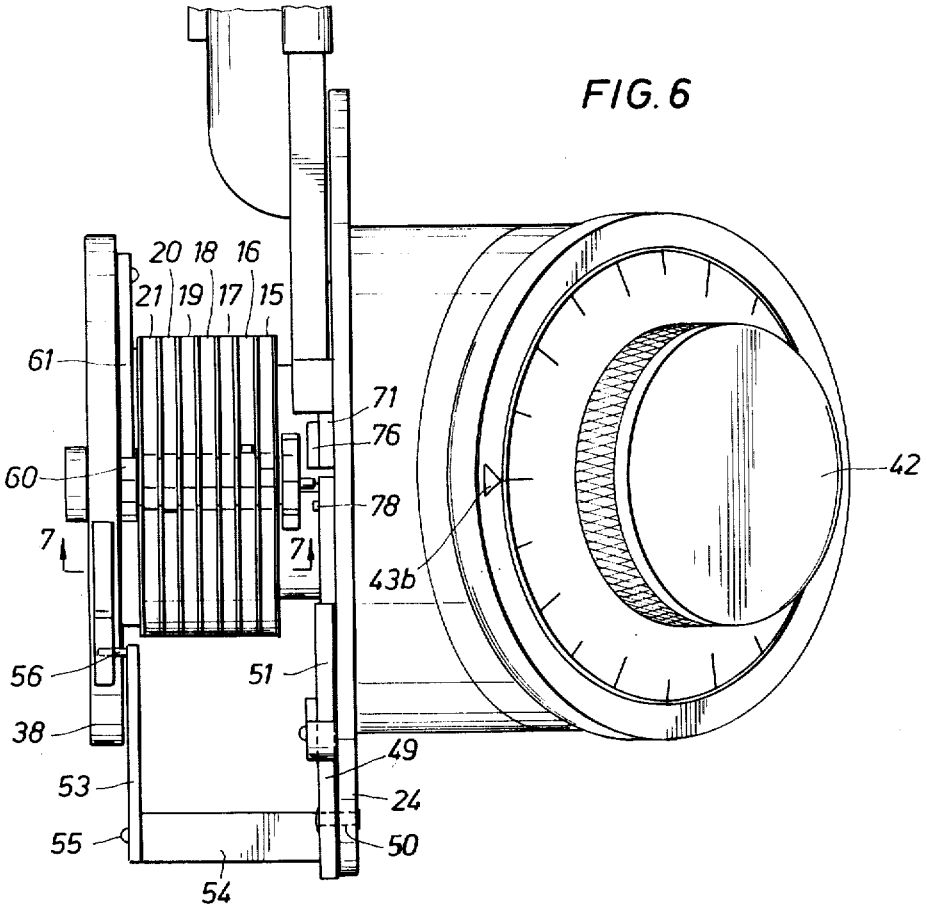
FIG. 6
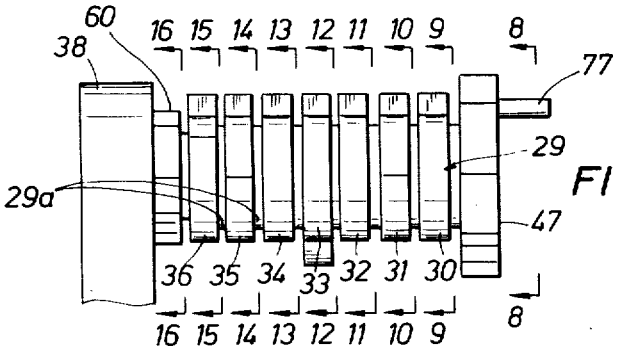
FIG. 7
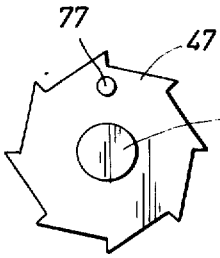
FIG. 8
FIG. 12
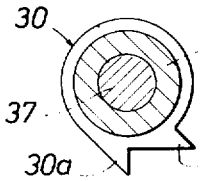
FIG. 9
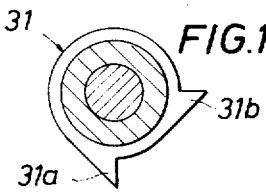
FIG. 10
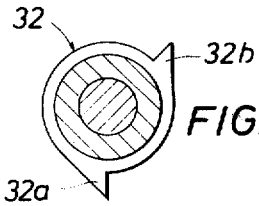
FIG. 11
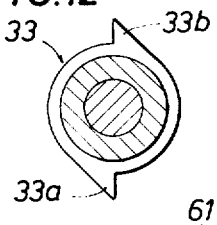
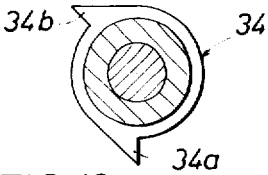
FIG. 13
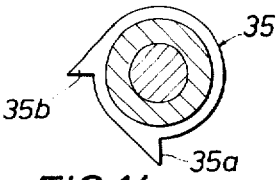
FIG. 14
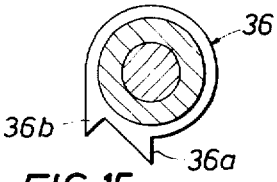
FIG. 15
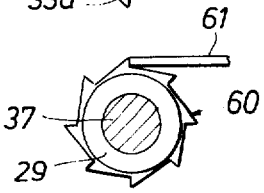
FIG. 16

FIG. 17
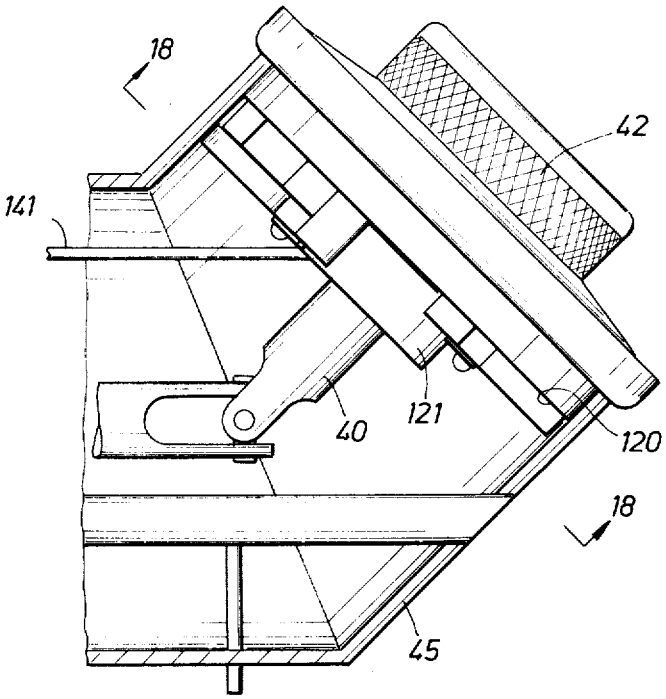
FIG. 18
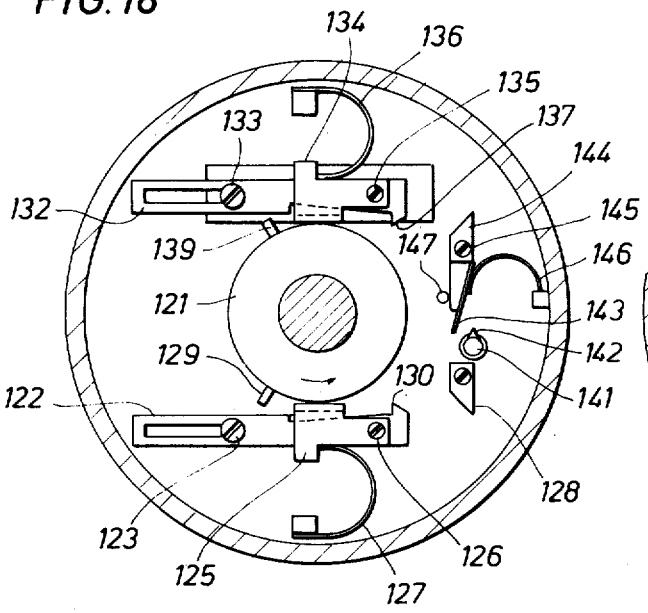
FIG. 19
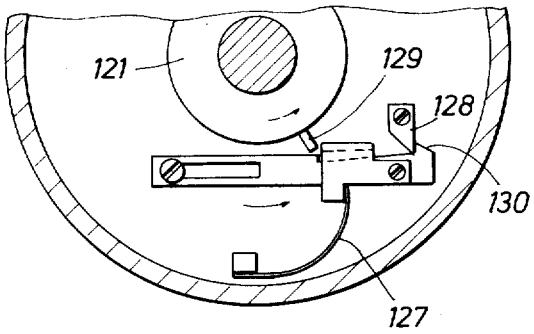
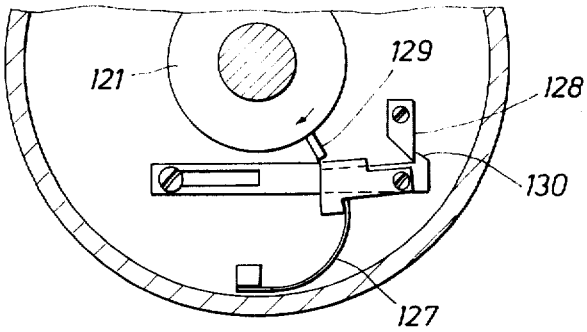
FIG. 20

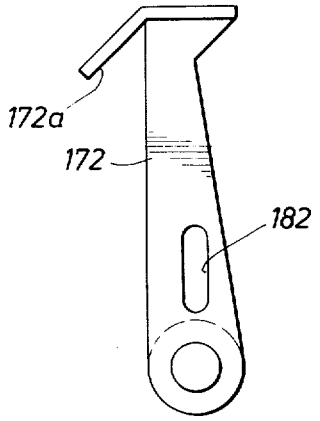
FIG. 23
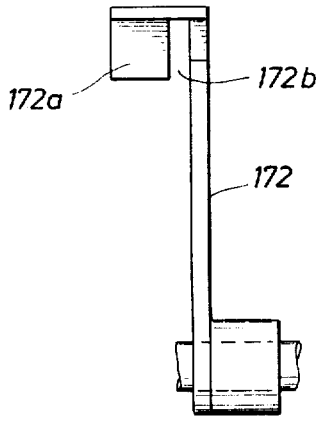
FIG. 22
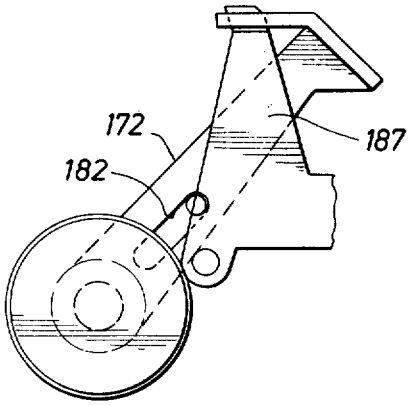
FIG. 24
FIG. 25
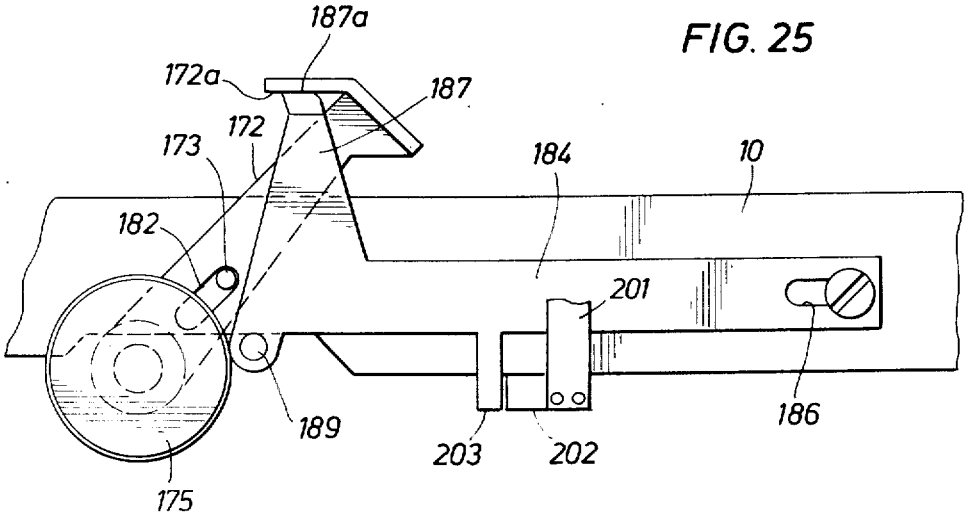

COMBINATION LOCK

This is a continuation-in-part of an application, Ser. No. 479,164, filed June 13, 1974 and entitled Combination Lock, now abandoned.

This invention relates to combination locks generally. In one of its aspects it relates to such locks where the dial is moved in one direction to position the tumblers. In another aspect, this invention relates to an improved tumbler for combination locks. In yet another aspect the invention relates to an improved lock bolt operating assembly.

In conventional combination locks, only combinations having three numbers are available because such locks can conveniently employ only three tumblers. One is a driving tumbler, which rotates the other two. There have been combination locks proposed that employ more than three tumblers, but the drive mechanisms for the tumblers of these locks is unduly complicated.

Therefore, it is an object of this invention to provide an improved combination lock having a reliable tumbler drive mechanism of simple construction that allows any desired number of tumblers to be employed.

It is another object of this invention to provide a combination lock having a plurality of tumblers where the combination cannot be felt or heard by a pick lock attempting to open the lock without knowing the combination.

It is another object of this invention to provide an improved tumbler for combination locks that provides for changing the combination.

It is another object of this invention to provide an improved bolt operating assembly that prevents the bolt from being moved from its open to its closed position from outside the door.

These and other objects, advantages for features of this invention will be apparent to those skilled in the art from a consideration of this specification, including the attached drawings and appended claims.

In the drawings:

FIG. 6 is a view in elevation of the lock of FIG. 1 looking from above the lock;

FIG. 7 is a side view looking in the direction of the arrow 7—7 of FIG. 6;

FIG. 8 is a view looking in the direction of the arrow 8—8 of FIG. 7;

FIGS. 9–16 are sectional views taken along line 9—9 through 16—16 of FIG. 7;

FIG. 17 is a side view of the dial portion of the lock in elevation;

FIG. 18 is a sectional view taken along line 18—18 of FIG. 17;

FIGS. 19 and 20 are partial views similar to FIG. 18 showing the mechanism in different positions;

FIG. 22 is a front view in elevation of one member of the bolt operating mechanism of the embodiment of the lock of FIG. 1;

FIG. 23 is a side view in elevation of the member of FIG. 22;

FIG. 24 is a side view in elevation of a portion of the bolt operating mechanism including the member of FIGS. 22 and 23;

FIG. 25 is a side view in elevation of a larger portion of the bolt operating mechanism showing the members of FIG. 24 in a position different than the position of FIG. 24;

The embodiment of the lock of this invention adopted for use as a door lock, as shown in FIGS. 1–25, will be described first.

Figures 1, 21:
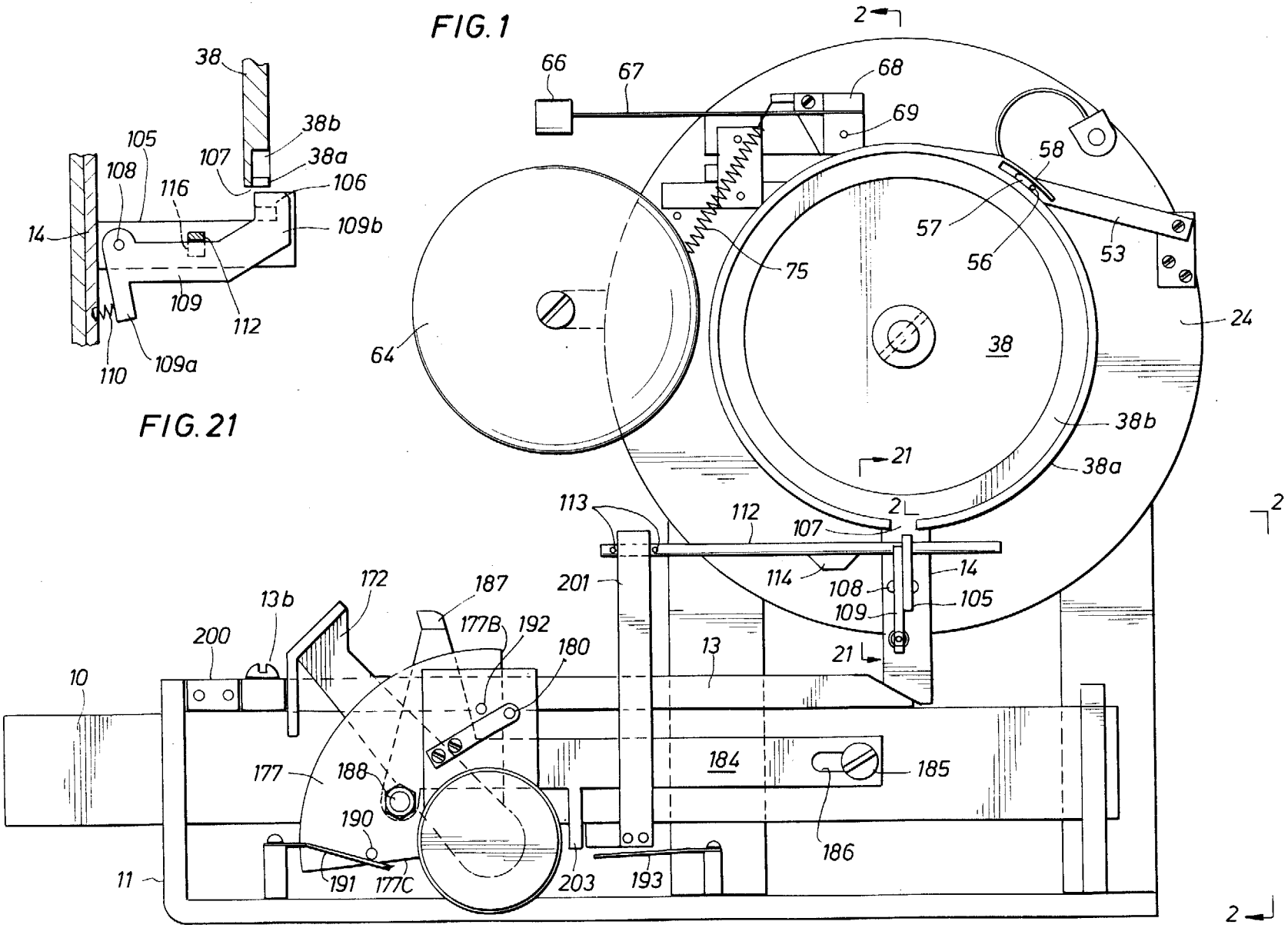
FIG. 1 is a view in elevation of an embodiment of the lock of this invention adapted for use as a door lock and looking at the lock from the rear of inside with the door in which the lock is positioned not shown.
FIG. 21 is a view taken along line 21—21 of FIG. 1.

The lock includes bolt 10 that is supported for reciprocal movement by base 11. As shown in FIG. 1, the bolt is in the locked position. It is movable to the right to the unlocked position by knob 12 by means of a mechanism to be explained below.

Fence means are provided to hold the bolt in the locked position when the fence means is in one position, and to release the bolt for movement to the unlocked position when the fence means has moved to a second position. In the embodiment shown, bar 13 is connected adjacent one end to the top of bolt 10 by machine screw **13*b* to pivot around the axis of the screw. The other end of bar 13 is beveled, as shown in FIG. 1, and usually is in position to engage the beveled end of fence rod 14 when the bolt is opened. If the fence rod 14** cannot move upwardly, it will effectively hold the bolt from moving to the open position.

Figures 2, 3:
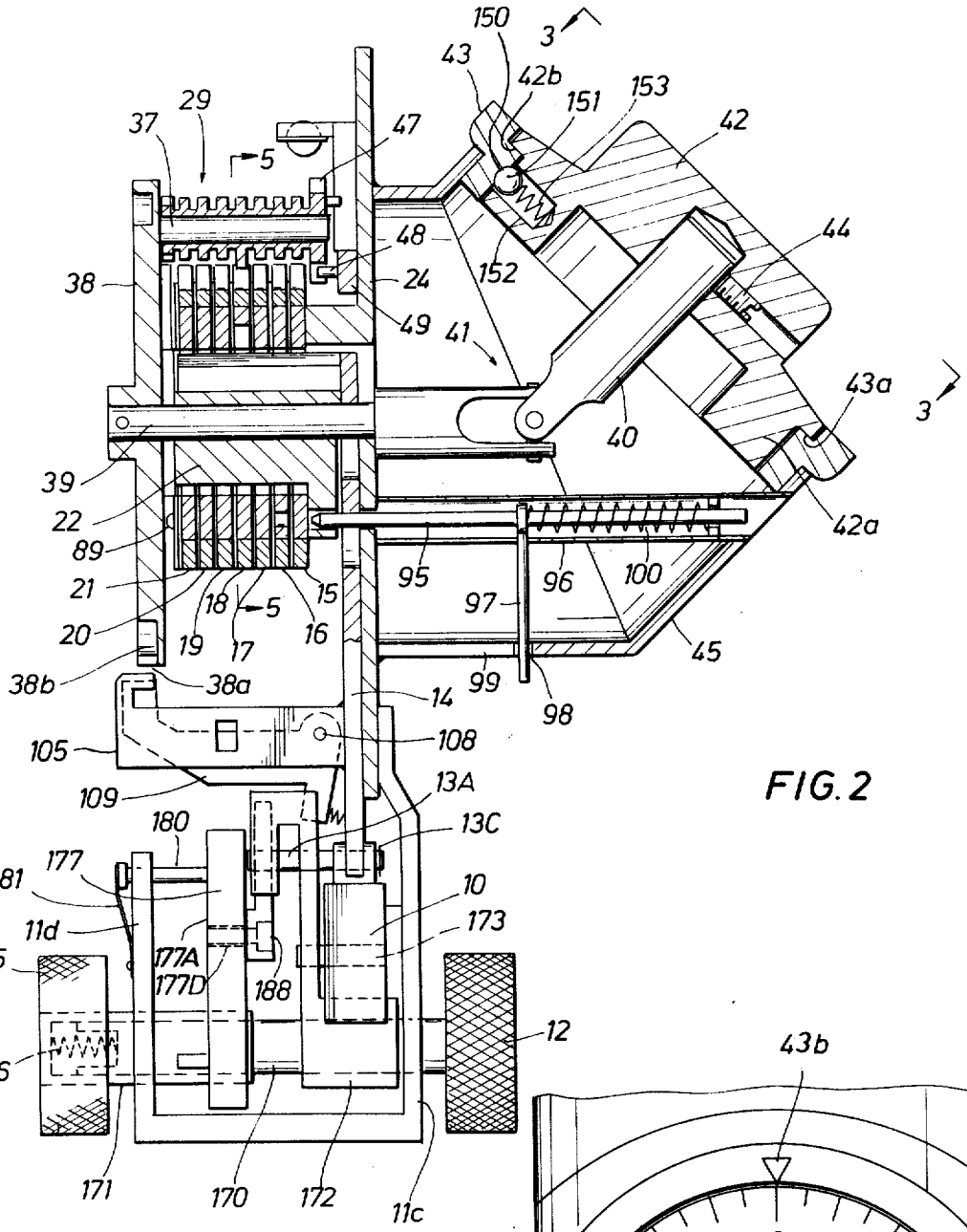
FIG. 2 is a view partially in section and partially in elevation taken along line 2—2 of FIG. 1.
FIG. 3 is a view looking in the direction of the arrows 3—3 of FIG. 2.
Figure 4:
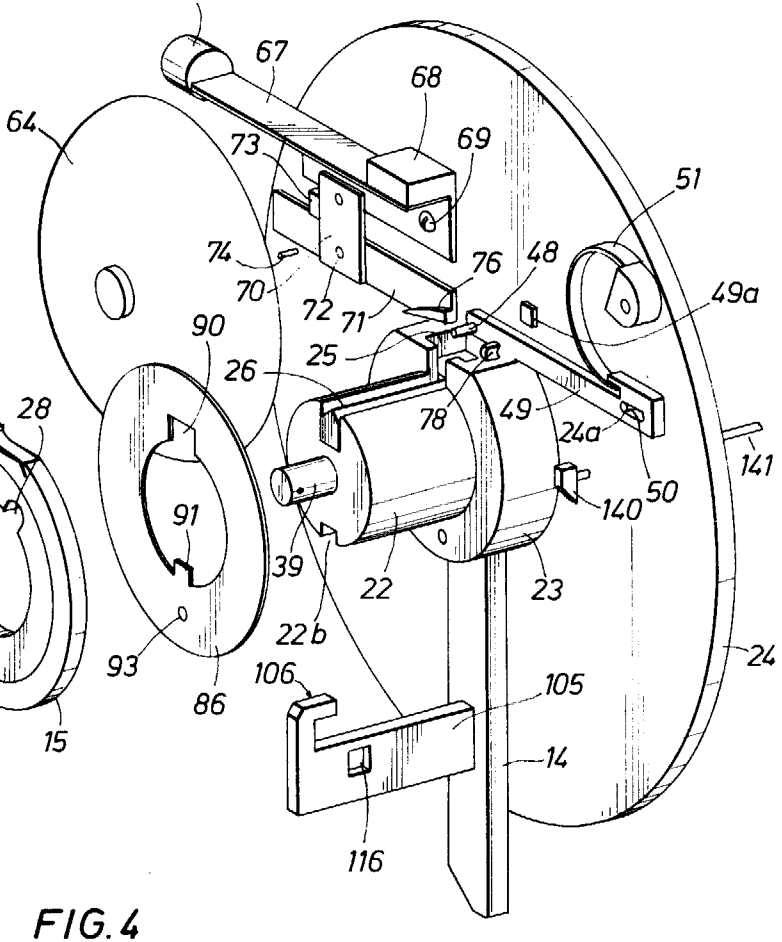
FIG. 4 is an exploded view of the tumbler and fence assembly of the lock of FIG. 1.
Figure 5:
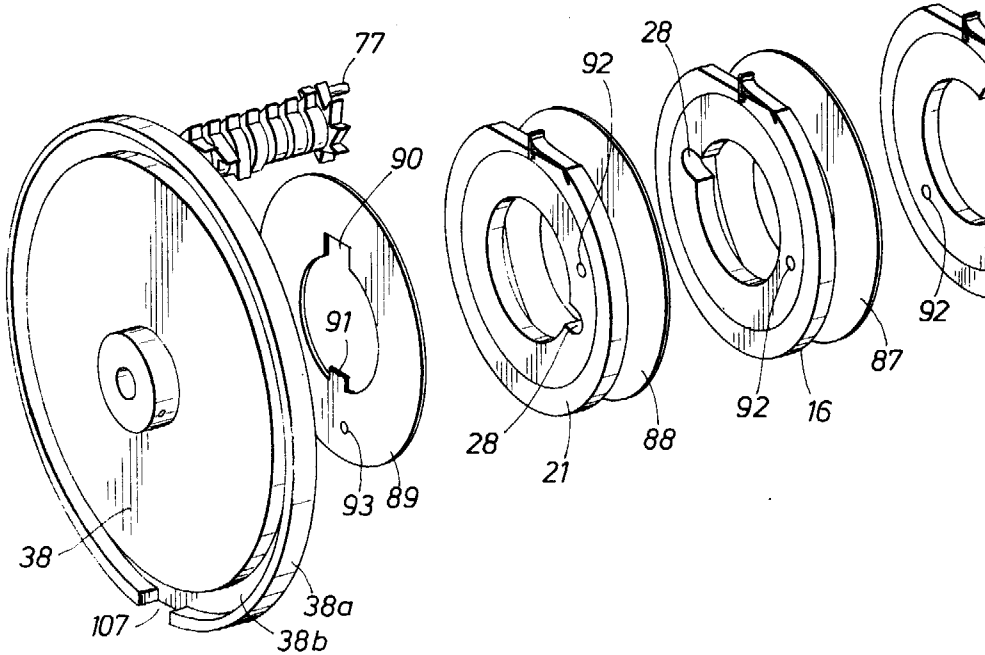
FIG. 5 is a cross-sectional view taken along line 5—5 of FIG. 2.
Figure 5:
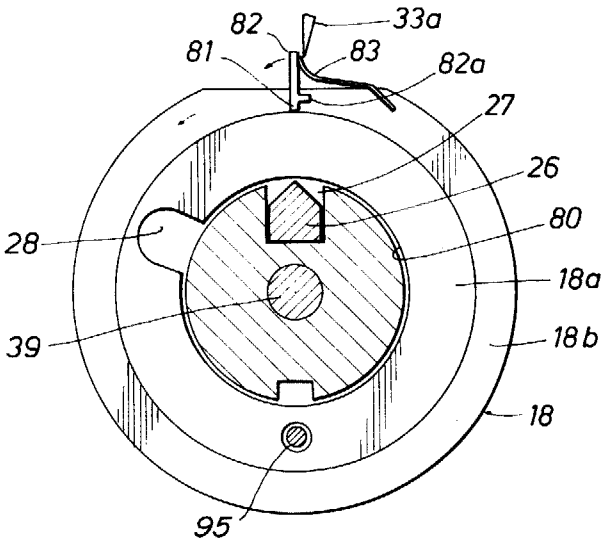

The lock includes a plurality of tumblers. In the embodiment shown, seven are used, numbered 15–21, as shown in FIG. 2. Means are provided to mount the tumblers for individual movement to a preselected relative position to open the lock. In the embodiment shown, (FIG. 4), the tumblers are disc-shaped, having a central opening to allow them to be mounted in side-by-side relationship on hub 22 for individual relative rotation around a common axis, i.e., the axis of hub 22. The hub includes flange 23 for mounting the hub to mounting plate 24, which is the front face of the lock. The flange also has slot 25 into which fence rod 14 extends for connecting to fence 26. The fence is located in slot 27 of hub 22, as shown in FIGS. 4 and 5. Each tumbler has gate 28 on its inner periphery. Each gate is designed to receive fence 26 and allow it to move upwardly, thereby allowing rod 13 to cam fence rod 14 upwardly and out of the way so the bolt can be moved to the open position. If all of the gates of the tumblers are not in position to receive the fence, then the fence can't move upwardly and the lock cannot be opened. Thus, to open the lock, all the tumbler wheels must be located in a preselected relative position so that the gate of each tumbler wheel is in position to receive fence 26. The positioning of the tumbler wheels in this manner, of course, can be done in the manner described below when the combination to the lock is known.

In accordance with this invention, means are provided for moving the tumblers sequentially to said preselected position relative to the other tumblers to open the lock including a plurality of tumbler engaging members, means mounting the members for movement to a plurality of positions, and means for moving the members to said plurality of positions with one of said members being located in each position to engage one of the tumblers and move it with the member. In the embodiment shown, cylindrical member or drum 29 has a plurality of longitudinally spaced annular grooves 29*a* that divide the drum into a plurality of longitudinally spaced annular surfaces. In this embodiment, seven such surfaces 30–36 are formed, one for each tumbler. On each annular surface is a tumbler engaging member, which in this embodiment are lugs 39*a*–36*a*. As shown in FIG. 2, drum 29 is mounted on shaft 37 which, in turn, is connected to disc 38. Disc 38 is mounted for rotation with shaft 39, the longitudinal axis of which coincides with the longitudinal axis of hub 22 around which the tumbler wheels are mounted to rotate. Shaft 37, then, is located with its longitudinal axis parallel to the longitudinal axis of the axis of rotation of the tumbler wheels and will be moved around that axis by disc 38 as the disc is rotated by shaft 39. Shaft 39 extends through front plates 24 and is connected to dial shaft 40 by universal joint 41. Dial 42 is connected to shaft 40 so that rotation of the dial will rotate shaft 39. Dial 42 is supported for rotation by annular member 43 which has a cylindrical opening to receive cylindrical portion 42*a* of the dial. It also has surfaces 43*a* to engage flange 42*b* of the dial and limit the distance the dial can enter the opening of member 43. Set screw 44 locks the dial to shaft 40. Tubular housing 45 is connected to front plate 24 and supports the dial assembly, as shown in FIG. 2. Housing 45 is angled upwardly so that the dial is more easily observed by the person operating the lock, since normally the dial will be below normal eye level.

In accordance with the invention, drum 29 is mounted for movement between a plurality of positions where one of the tumbler engaging members or lugs 30*a*–36*a* is located in each of these positions to engage one tumbler and move it with the drum as it is rotated around the axis of rotation of the tumbler. In the embodiment shown, ratchet wheel 47 of FIG. 8 is attached to the inner end of shaft 37. It is positioned adjacent front plate 24, as shown in FIG. 2, where its teeth can be engaged by pin 48 attached to arm 49. The arm is connected to front plate 24 by pin 50 that extends through elongated slot 24*a*. Bow spring 51 urges the arm up and to the right to the position shown in FIG. 4 with pin 50 holding the arm against further movement to the right. Stop 49*a* limits the upward movement of the arm. So positioned, as the dial rotates the drum in a counterclockwise direction, as viewed from the front of the lock, back to the position shown in FIG. 6, pin 48 engages one of the teeth of ratchet 47 and moves the drum to the next position. In this embodiment, ratchet wheel 47 has eight teeth, thus, for a complete revolution of drum 37, ratchet wheel 47 will be stepped eight times.

As explained above, the tumbler engaging members, lugs 30*a*–36*a*, are mounted on means that move them between a plurality of positions with one of the members located to engage one of the tumblers in each position. In FIGS. 9–15, each figure is a section through drum 29 adjacent each of the annular surfaces 30–36. In each section, the annular surface is shown having been moved in sequence into position for the lug thereon to engage one of the tumblers. Beginning with FIG. 9, lug 30*a* is in position to engage and move tumbler 15. None of the other lugs are in position to engage the tumbler with which they are associated. After the dial has been rotated to position tumbler 15 in the desired position, as indicated by the graduations on the dial, the dial returns the drum back to the original starting position, usually the number zero on the dial. As the drum returns, pin 48 rotates the drum through a sufficient angle to move lug 30*a* out of position to engage tumbler 15 and moves lug 31*a* into position to engage tumbler 16, as shown in FIG. 10. As dial 42 is rotated clockwise, lug 31*a* will rotate tumbler 16 through the same angle, say 216°, which will bring the number 6 into position below index 43*b*, if the number 6 is the second number of the combination. Returning the dial to zero in a counterclockwise direction will cause pin 48 to ratchet drum 29 to the next position which locates lug 32*a* to engage the protrustion on tumbler 17. Rotation of the dial clockwise will then move this tumbler through the desired angle. This process is repeated to position lugs 33*a*, 34*a*, 35*a*, and 36*a* to sequentially rotate tumblers 15–21 individually to the proper position for their gates to receive the fence and allow the lock to be opened. Note that in each position shown in FIGS. 9–15, only one lug is positioned to engage and move a tumbler as the dial is rotated.

Means are provided to bring all of the tumblers to a known orientation before dialing the combination. In the embodiment shown, the annular surfaces on the drum carry a second set of lugs 30*b*–36*b*. These lugs are positioned along a line that is parallel to the longitudinal axis of the drum. As explained above, ratchet wheel 47 has eight teeth. This provides seven positions for moving the seven tumblers individually, as shown in FIGS. 9–15. In the eighth position, aligned lugs 30*b*–36*b* are positioned to engage all seven tumblers and rotate them together to a preselected starting position. When this is being done, the dial should be moved through 360° to insure that lugs 30b–36b engage all of the tumblers and bring their protrusions into alignment.

Stop means are provided to limit the rotation of the dial in the counterclockwise direction. As shown in FIGS. 1 and 6, stop arm 53 is mounted on front plate 24 by mounting bar 54 and pivot pin 55. Stop arm 53 is positioned so that stop pin 56 attached to the end thereof rides on the outer surface of disc 38. Thus, when disc 38 is rotated in a clockwise direction, as viewed in FIG. 1 (as a result of counterclockwise rotation of the dial), pin 56 will enter slot 57 formed between guide arm 58 and the outer surface of the disc, and then stop further rotation of the disc when the pin engages the bottom of the slot. The disc can be rotated in the other direction, counterclockwise, (clockwise rotation of the dial), as viewed in FIG. 1, as many revolutions as desired because pin 57 will simply ride over arm 58 and not interfere in any way with rotation of the disc or dial in that direction. The purpose of pin 56 and the related stop member is to provide a fixed position to which the dial can be returned and the person manipulating the dial will know that he is then in position to dial another number of his combination. As explained above, as the dial is rotated back against stop pin 56, ratchet pin 48 will ratchet the ratchet wheel and lug carrying drum one step to the next of the eight positions.

As mentioned above, and as will be explained in detail below, each tumbler wheel has a protrusion to be engaged by the associated lugs on the drum. To keep the drum from rotating under the torque imposed thereon by the tumbler wheel as it is being rotated, locking wheel 60 is attached to drum 29 adjacent disc 38. Spring arm 61, as shown in FIGS. 6 and 16, is positioned to engage the teeth of locking wheel 60 to hold the drum from clockwise rotation, as viewed in FIG. 16, as it is moving the tumbler wheels, which is the direction the drum would tend to rotate when moving the tumblers. Since the drum is stepped by ratchet wheel 47 in a counterclockwise direction, with each step spring arm 61 will simply move from tooth to tooth and always be in position to hold the drum from clockwise rotation.

It is desirable that means be provided to indicate when the drum is in position for lugs 30b–36b to move all of the tumblers to their starting position preparatory to dialing the combination of the lock. After the seventh digit of the combination has been dialed, of course, the next position for the drum is the one where all of the tumblers will be moved. After the door has been closed or the bolt moved back to the locked position, it will be desirable to scramble the tumblers to lock the door. This can be done by rotating the dial. The lug drum will be in position number eight, so all of the tumblers will be moved. If the dial is rotated until all of the tumblers are brought to the desired starting position, the lock can be reopened by simply dialing the combination. If the lock is tampered with, however, when the time comes to reopen the lock, the drum may be in any one of its possible eight positions. If the person opening the lock did not have a way of learning the position of the drum, he might spend a considerable amount of time manipulating the dial with no success because he could be moving the third tumbler when he thinks he is moving the seventh tumbler.

Therefore, in accordance with this invention, means are provided to indicate to the operator of the lock when the drum is in position to move all of the tumbler wheels. Knowing this, the operator can rotate the dial through the proper angle to properly position the tumblers and begin dialing the combination confident that he is moving the tumbler wheels in the proper sequence. In the embodiment shown, the means for indicating this does so with an audible signal. It includes bell 64 and clapper 66. The clapper is mounted on spring arm 67 which, in turn, is supported by bracket 68 that is pivotally connected to plate 24 by pin 69. Plate 70 is attached to bracket 68 and supports arm 71 by pivot pin 72. Stop 73 limits the pivotal movement of the arm in a clockwise direction. Stop pin 74 limits the pivotal movement of the entire assembly in a counterclockwise direction as urged by spring 75. Lug 76 on the end of arm 71 is positioned to be engaged by pin 77 carried by the ratchet wheel when the drum is in the eighth position or station. At all other stations the pin will not engage the lug. When it does, however, continued movement of the dial will cause the pin to pivot the bracket assembly around pin 69. When the pin has cleared the lug, spring 75 will snap the bracket back against stop pin 74. The force of this movement will cause spring arm 67 to yield sufficiently for clapper 66 to strike bell 64 and thereby indicate to the person manipulating the lock that he is now moving all tumblers around to their starting position and his next operation will be to dial the combination and open the lock. In all other positions of the ratchet wheel, pin 77 will pass over lug 76 as the drum is moved by the dial. When the dial is being returned after sweeping all tumblers to their starting position, pin 77 will again engage lug 76. It can move out of the way be pivoting arm 71 around pin 72.

As explained above, as drum 29 is moved counterclockwise, it is stopped by pin 56 in slot 57. As it moves to this position, it is rotated on its longitudinal axis by ratchet 47 to the next of its eight positions or stations. This rotation must occur after the drum has moved by the protrusions on the tumblers. This means that the drum must be rotated more than 360° from its starting position when it is moving all of the tumblers to bring all of the protrusions into alignment before dialing the combination. This can be done by observing the angle of rotation indicated by the dial and making sure that this clearance is provided. Preferably, however, stop means are provided that stops the rotation of the dial, as the drum is moving all of the tumblers, when the tumblers have been moved to the desired position.

In the embodiment shown, pin 77 on the ratchet wheel engages cupped lug 78 on arm 49 (FIG. 4) as the drum approaches 360° of clockwise rotation carrying all of the tumblers. Slot 24a allows the pin to carry the stop and arm with it until pin 50 engages the end of slot 24a. The slot is designed to stop the rotation of the dial when the tumblers are properly positioned. Bow spring 51 will return arm 49 to the position shown when pin 77 moves out of engagement with cupped lug 78. In all other positions of the ratchet, pin 77 will not engage cupped lug 78. This allows the operator when dialing, should he accidentally go by the desired number when dialing the combination, to continue rotating the dial clockwise until he reaches the desired number on the dial.

It is another feature of this invention to provide an improved tumbler for combination locks. All of the tumblers of the embodiment shown in the drawings are of the same construction, so only one will be described in detail. Referring to FIG. 5, tumbler 18 includes a hub 18*a* and rim 18*b*. The hub is an annular member, having opening 80 that is just slightly larger in diameter than the diameter of hub 22 upon which the tumblers are positioned for rotation. Hub 18*a* also contains gate 28 into which fence 26 moves when the tumblers are positioned in accordance with the combination of the lock. Rim 18*b* is made of a resilient material, such as spring steel, and has radial split 81 to allow the rim to be expanded when installed on hub 18*a* so that it will grip the hub with sufficient force that it will not move relative to the hub as the tumblers are moved around hub 22. As explained above, each tumbler wheel has a protrusion positioned to be engaged by the lugs on the drum. In the embodiment shown, the protrusion comprises radially extending member 82 that is located in split 81 and extends beyond the periphery of the tumbler. A fragment of a lug, in this case lug 33*a*, is shown in FIG. 5 just before it engages protrusion 82. Spring 83 exerts a light force on protrusion member 82, tending to hold it firmly in engagement with the left hand side of split 81 in the rim and in position to be engaged by the lug. Also, helping to hold the protrusion in the split in an upright position, is arm or key 82*a* which extends into a slot provided therefor in the righthand side of the split. There is enough clearance between the key 82*a* and its slot to permit this movement. These opposite forces tend to pry open the split in the rim, which reduces the frictional grip the rim has on the hub allowing it to be moved relative to the hub with less force. The protrusion would have this same tendency when it is not desired for the rim to move relative to the hub, as during normal operations, but the force required to move the tumbler wheel on hub 22 during such operations is not enough to pry the slot open and allow relative rotation between the rim and the hub.

In accordance with another feature of this invention, means are provided for opening the lock should the combination be lost of forgotten. In FIG. 4, the assembly of the tumbler wheels is shown in an exploded view, with only three tumbler wheels, 15, 16, and 21 being shown for simplicity. Also shown are the spacers that are located on each side of the tumblers to prevent the movement of one from tending to move those adjacent thereto. With seven tumblers, eight spacers are used. As shown, spacer 86 is located between tumbler 15 and flange 23. Spacer 87 is placed between tumblers 15 and 16. Spacer 88 would be between tumbler 20 (not shown) and tumbler 21. Spacer 89 is placed between tumbler 21 and back disc 38 and is preferably thicker for purposes to be described below. Each spacer has a slot 90 to receive the fence and a tongue or key 91 to engage keyway 22*b* in hub 22 to hold the spacers from rotation. Each tumbler wheel has opening 92 through its hub. Each spacer has opening 93 spaced the same distance from the centerline of hub 22. The purpose of the openings is to allow the hubs of all of the tumblers to be brought to a predetermined. relationship to allow the lock to be opened when using a master combination, which will probably be different for each lock. The master combination will be available from the company manufacturing the lock or it can be stored away in a safe place by the owner. In any event, this combination will be unique for each lock.

To use the master combination to open the lock when the current combination has been lost, pin 95 is positioned in housing 45 to pass through openings 92 of the tumbler wheels and openings 93 of the spacers. Pin 95 is located in tubular housing 96 that is supported by housing 45 and front plate 24. The pin extends through the front plate in alignment with the path of rotation of openings 92 and 93. Latch pin 97 normally holds the pin out of engagement with the tumblers, as shown in FIG. 2, by being moved laterally into engagement with slot 98 in one side of slot 99 in the bottom of housing 45. When it is necessary to use the master combination, latch pin 97 is released and spring 100 resiliently urges pin 95 through opening 93 of spacer 86 into engagement with first tumbler wheel 15. By slowly rotating this tumbler wheel, its opening 92 will come into a position to receive pin 95 which, under the urging of spring 100, will move through the opening. This can be felt by the forward movement of latch pin 97. Further movement of tumbler wheel 15 will now be stopped. Then, by turning the dial back to ratchet, tumbler 16 can be rotated until the rod enters its opening 92. This process is continued for each tumbler until rod 95 extends through openings 92 and 93 of all the tumblers and spacers. Preferably, as stated above, spacer 89 is sufficiently rigid to adequately support the end of the pin against the lateral forces to be imposed on it during the next operation.

With all the hubs held against rotation, drum 29 is then moved to its eighth position and all of the rims will be rotated relative to the hub of the tumblers to bring all of their protrusions 82 into alignment, as would be the case when normally preparing to open the lock. When this has been accomplished, the master combination can be used which is based on the relative position of opening 92 and gate 28 of each tumbler which is predetermined when the lock is manufactured. Pin 95 is withdrawn, of course, before the master combination is dialed.

After the lock is opened in this manner, it will be desirable to change from the master combination to a current combination so that the master combination can be carefully hidden away again for such emergency use. To accomplish this, the bolt is moved to a position about half way between its opened and locked positions. As will be explained below, this allows the dial to be rotated, which is also explained below, cannot be done when the bolt is in its open position. In this position of the bolt, the fence is still in engagement with gates 28 to hold the hubs of the tumblers from rotation, allowing the rims to be rotated to any desired combination. To set the new combination, as indicated by the dial, the rim of each tumbler is moved to the desired combination number for that tumbler. The lock can then be closed and the new combination will continue to open the lock until it is desired again to change the combination currently being used.

In the embodiment shown, a safety feature is incorporated in the lock to keep the combination of the lock from being inadvertently changed while the lock is open. In other words, when the lock is in the open position and the fence is in the gates of the tumblers, any movement of the dial could inadvertently change the position of one of the rims of the tumblers relative to its hub, and thereby change the combination. If this was done accidentally, the operator may not know that it occurred, and his current combination, then, would not open the lock and he would have to go through the procedure described above, using the master combination. To avoid this, in accordance with this invention means are provided to lock the dial against rotation while the lock is open. As shown in FIGS. 1 and 4, J-shaped arm 105 is attached to fence rod 14. Hook 106 of the arm is located below rim 38*a* of disc 38 when the bolt is in its closed position. This rim is formed by an annular groove 38b in the disc. The rim also has slot 107 in the rim leading into the groove. Slot 107 is positioned so that it is above hook 106 when the dial turned counter-clockwise against its stop which is normally zero on the dial. The reason for this is to require the operator of the lock to return the dial to zero after setting the last tumbler before the lock can be opened, since, if it's not returned to zero, and slot 107 is not positioned over hook 106, upward movement of fence rod 14 will be prevented by the hook hitting rim 38a of disc 38. With the dial on zero, when the lock is opened, the fence can move upwardly into the gates and hook 106 will move into annular groove 38b of the disc.

Mounted on arm 105 by pin 108 is change lever 109. The stop member has one leg 109*a* located adjacent fence rod 14. Spring 110 located between leg 109*a* and fence rod 14 urges the stop member to pivot around pin 108 to the position shown. In this position, leg 109*b* extends across the opening in hook 106 and when the hook moves through slot 107, leg 109*b* will be positioned in the slot in the rim and prevent further rotation of the dial. This prevents the inadvertent changing of the combination.

As explained above, there will be times when it is desired to change the combination, therefore means are provided to disenable the rotation lock means when desired. In the embodiment shown, square hole 116 is cut in arm 105 is shown in FIG. 21. Rod 112 passes through this hole and is secured adjacent one end to drive member 201 by pins 113. Member 201 is secured to the underside of bolt 10. When the lock bolt is moved to half lock, fence rod 14 is raised so hook 106 of arm 105 is in alignment with annular groove 38*b*. At this point, cam 114, a part of rod 112, is passing through square hole 116 and has pushed change lever 109 down out of alignment with rim 38*a*. This allows disc 37 to be turned by the dial. The fence is holding the hubs of the tumblers so the outer rims can be slipped for combination change.

Since in the manipulation of this lock it is important that the dial be brought back to a reference point after each movement of the tumbler to insure that the ratchet drum is moved to bring another leg into position to engage the next tumbler, means are provided to supply the power to move the dial back to its zero point automatically when the person operating the dial brings it within a given angular distance from the zero point. In the embodiment shown in FIGS. 17–20, the power dial assembly includes mounting plate 120 attached to housing 45. As viewed in FIG. 18, looking up from under the dial, hub 121 of the dial is secured to shaft 40 and extends through plate 120. Latch member 122 is mounted on plate 120 for pivotal and limited longitudinal movement by pin 123 located in slot 124. Drive member 125 is pivotally connected to member 122 by pin 126. This member is engaged by spring 127 to resist movement of the member toward pawl 128 mounted on plate 120, and to provide a resilient force to bring the member back and up to the position of FIG. 18 after it is released from the pawl as explained below. Hub 121 has pin 129 that engages drive member 125 as the dial is rotated away from the index which moves the hub counterclockwise, as viewed in FIG. 18. Pin 129 engages the back of drive member 125 and moves latch member 122 to the right.

As hub 121 rotates, pin 129 engages drive member 125 and moves latch member 122 toward pawl 128. Hook 130 will engage pawl 128 and the beveled surfaces thereon will pivot member 122 downwardly against 127 until the hook has moved by the pawl. When this occurs, the spring will move the hook into position to catch the pawl when pin 129 has moved out of driving engagement with drive member 125. This occurs after the hub has been rotated through a given angle. In FIG. 19, the pin is shown just before moving out of engagement with the drive member.

When the combination member has been dialed, the dial will be returned to zero. Pin 129 will clear drive member 125 by causing it to pivot on pin 126 as shown in FIG. 20. It will then engage member 122 forcing it to pivot downwardly far enough to release hook 130 from the pawl. Spring 127 will then move arm 122 to the left to the position of FIG. 18 with enough force to rotate the dial against the stop. As explained above, this arrangement insures that the dial is returned to the proper position after each member is dialed, and also insures that the ratchet drum assembly has been rotated so that the next tumbler will be moved when the dial is again rotated.

A similar arrangement is provided to take over the rotation of the dial and insure that the tumblers are all rotated far enough when sweeping all protrusions into alignment preparatory to dialing. Latch member 132 is mounted on plate 120 by pin 133 in the same manner as member 122 described above. Drive member 134 is mounted by pin 135 on the member and spring 136 operates as dial spring 127. Hook 137 is latched to pawl 144 by pin 139 when the hub is rotated clockwise as viewed in FIG. 18. This arrangement differs from the power zero return in that latch member 132 is not released by pin 139, but is arranged to allow passage of the pin in a counterclockwise direction only, as it is desired to release the member only when sweeping the tumblers. At this point, cam 140 (FIG. 4) is positioned to be engaged by pin 77 when it is in station eight. The pin moves cam 140 and rod 141, which moves dog 142 (FIG. 18) out of holding engagement with arm 143. This releases pawl 144 for rotation around pin 145. This allows spring 136 to move latch member 132 to the left, carrying pin 139 and the hub and dial to the desired position. Returning the dial to its starting point causes pin 139 to relatch the latch member. Pawl 144 has already been returned to holding position by spring 146 moving the pawl against stop 147. At no time does pin 139 pass member 134 when hub 121 is turned clockwise as viewed in FIG. 18, but rather moves assembly 132 only far enough for hook 137 to catch behind pawl 144, after which point hub 121 is always returned counterclockwise for dialing. Reference to pin 139 passing pin 134 means only that when dialing, pin 139 can depress and then pass member 134 as many times as desired. This means that, as viewed in FIG. 18, pin 139 can turn counterclockwise to depress and pass member 134.

Another important feature of this invention is that the master combination can be changed to any desired set of digits easily and effectively. By removing the trim plate (not shown) on the inside of the door and disc 38, the tumblers can be rearranged to provide a new master combination.

As viewed in FIG. 2, annular member 43 has 10 sockets 150 formed as hemispherical depressions evenly spaced around its interior periphery. These sockets are slightly less in depth than half the diameter of ball 151 located in hole 152 in the outer periphery of dial 42. Spring 153 presses the ball against the inner periphery of member 43 in line with depressions 150. As dial 42 is turned, the ball drops into each of the 10 sockets in turn as the dial is rotated 360°. Thus, during one full turn of the dial clockwise from the starting position, the user will detect 10 positive points at which the dial has a tendency to come to rest.

For example, if the first three numbers of the combination are 4-2-5, as the user turns to 4 on the dial it is not necessary to look at the dial to tell when he has arrived at 4. He can feed the four positive points. After returning the dial to stop point at the starting position, he could turn until he felt the ball move into two depressions and so on. This allows the lock combination to be dialed in the dark. With light available, the tendency of the dial to stop at each of its ten positions makes dialing the combination easier.

The bolt actuating assembly includes shaft 170 on the dial side of the lock on which knob 12 is mounted. The shaft extends through a bearing hole in front plate 11*c* of frame 11, and into hollow shaft 171. The shafts are free to rotate relative to each other. Also mounted upon shaft 170 for rotation therewith is bolt driving member 172. Pin 173 attached to bolt 10 extends into a slot in the bolt driving member that is designed to move the pin and bolt longitudinally as the driving member is rotated by knob 12 and shaft 170.

Inside knob 175 is mounted on shaft 171 to rotate the shaft. Spring 176 located in a blind hole in the end of the shaft resiliently holds the knob in the position shown. The necessary keys and stops to allow the knob to have limited movement axially of the shaft while maintaining the ability to transmit torque to the shaft is not shown to help keep the drawings as simple as possible.

Means are provided to automatically lock the bolt open, when the lock is opened from the outside and to automatically lock the bolt closed, when the lock is closed from the inside. The latter thus functions as a night latch. In the embodiment shown, pin 180 extends through an opening in frame member 11*d* and is urged against fan-shaped member 177 by flat spring 181. As the fan-shaped member is rotated by knob 175, as described below, pin 180 slips off of the side of the member when it has reached the end of its rotation in either direction. As shown in FIG. 1, the bolt is in its locked position and pin 180 is holding member 177 from rotating to open the lock. The pin, then, serves as a night latch. In place, the lock cannot be opened from the outside. It is released from the inside by moving inside knob 175 against spring 176 causing shaft 171 to move the fan member to the right, as viewed in FIG. 2, out of engagement with pin 180. When fanshaped member 177 is rotated in the opposite direction by either, knob and bolt 10 is completely withdrawn, pin 180 drops in behind member 177 on the other side and in the same manner secures the bolt against being inadvertently thrown out to the locked position. The pin is released by pushing inside knob 175 towards the door, which moves hollow shaft 171 and fan-shaped member 177 out of engagement with the pin.

The bolt is locked open when the bolt is moved to the open position by either the inside or outside knob. Only the inside knob, however, can lock the bolt in its closed or locked position. This results because outside knob 12 cannot move fan-shaped member 177 far enough to clear pin 180 when opening the lock. Why this results will be described below.

The purpose of locking the bolt in open position by use of either the inside or outside knob is included in this invention for the express purpose of insuring against the door being inadvertently locked by either pranksters or absent-minded users.

Knobs 12 and 175 reciprocate bolt 10 through pin 173, which is secured to the bolt and extends into slot 182 in driving member 172 which is shown in FIGS. 22 and 23. The slot allows the pin to travel horizontally with the bolt as driving member 172 rotates around the axis of shaft 170.

As viewed in FIGS. 1 and 2, cam arm 172 is secured to shaft 170 for rotation therewith. When rotated, it serves to drive bolt 10 to locked and unlocked positions by pin 173 extending through both members. Pin 173 extends into slot 182 of cam arm 172, best seen in FIG. 23. As outside knob 12 turns shaft 170 and cam arm 172 clockwise from the position in FIG. 1, pin 173 moves down and then back up in slot 182.

As cam arm 172 is thus moved clockwise, as viewed in FIG. 1, by turning outside knob 12, fan-shaped locking member 177 is moved also, in the following manner. Bolt arm 184 is attached to the bolt by screw 185. Arm 184 has elongated slot 186 to receive the screw and provide a lost motion connection between the bolt and the arm. Thus, bolt arm 184 and attached vertical member 187 moves with the bolt. Pivot screw 188 extends through hole 189 of member 187 (FIG. 25) and is threaded into tapped hole 177*d* of fan-shaped locking member 177, as shown in FIGS. 1 and 2. Member 177, then, rotates with cam arm 172 in general, however, due to the difference in distance of pins 173 and 188 from the axis of rotation of main shaft 170, surface 172*a* of cam arm 172 overtakes point 187*a* at the top of vertical member 187 by the time bolt 10 is about three quarters withdrawn, as shown in FIG. 25. At this point, surface 172*a* forces point 187*a* to move to the right much faster and causes inside knob to speed up its rotation perceptibly. Arm 184, then, is no longer being pushed by pin 185 as arm 184 is now moving faster than the bolt.

The above-described action in turn causes side 177*a* (FIG. 2) of member 177 to pass locking pin 180, which, urged inwardly by spring 181, drops in behind side 177*a*. In this manner, when bolt 10 is completely withdrawn it is locked open so as to insure against inadvertently locking the door.

When inside knob 175 is turned counterclockwise to put on the night lock, pin 180 drops behind surface 177*b*. Pin 190 protruding out from member 177 depresses flat spring 191 causing a reverse pressure to be exerted upwardly against pin 190. When either the inside or outside knob is turned in the opposite direction, pin 180 will drop behind edge 177*c*, and protruding pin 192 on member 177 engages flat spring 193 and depresses it.

Inasmuch as the immediately preceding locking procedure in either direction is dependent only upon pin 180 having dropped in behind one side or the other of member 177, the user has only to bump or push inside knob 175 in order to cause fan-shaped locking member 177 to move over just enough for its outer surface to clear pin 180 for springs 191 or 193 to instantly rotate member 177 enough to bypass pin 180 and release the whole mechanism from its locked back or forward position. When the bolt is locked into open position, as viewed in FIG. 25, inside knob 175 is pushed or bumped inwardly to release pin 180. At this time, point 187*a* of member 187 moves over and up from its position under 172*a* into cutaway portion 172*b*, as viewed in FIG. 24, thus permitting point 187*a* to move upward as urged by spring 193 bearing against pin 192.

The above-described locking procedure functions as described whether the lock is open with fence rod 14 up or down. Neither knob can be turned to move the bolt, however, unless inside knob 175 is pushed inwardly. When tumblers of the lock have been scrambled (door securely locked from the outside), the night lock can still be used with no variations from the above-described means except that to unlock from the inside, knob 175 must be pressed in and held there as the knob is turned to move bar 13 over so that the bevel on its right hand end is moved out of alignment with the corresponding bevel on fence rod 14. Locking bar 13, pivoting at pin 13*b* thus bypasses vertical fence rod 14 for quick and positive opening of the lock and door from the inside under any and all circumstances. This is accomplished by member 177 pressing against bypass pin 13a secured into locking bar 13, as viewed in FIGS. 1 and 2.

Flat spring 13c (FIG. 2) secured to stop block 200 exerts pressure against the dial side of lock bar 13 bringing it back for reset against a bar stop on the dial side of 201 (not shown) secured to the back side of bolt 10, when bolt 10 is again returned to a locked position, as shown in FIG. 1.

Special note should be taken that when bolt 10 is thrown out to locked position with the outside knob, direct drive is accomplished through cam arm 172 and pin 173 working in slot 182, with members 177 and 187 being carried along by arm 202 (FIG. 1) pushing against pin 203 (FIG. 25). Note also that when bolt 10 is withdrawn, the outside knob also drives bolt 10 as above described, except that members 177 and 187 are being rotated per the force of pin 185 pushing against the right hand end of slot 186 in rod 184. But, when the bolt is thus withdrawn by using inside knob 175, bolt 10 is driven only by projecting lug 203 coming against arm 202, thus knob 175 working through shaft 171, member 177, and projecting lug 203, works ahead of knob 12 and does its own compensating manually.

In FIGS. 26–39, the invention is shown embodied in a padlock.

For use as a padlock, the bolt is in the form of U-shaped shackle 250 having parallel legs 251 and 252. The legs extend into housing 253 to be held there in a manner to be described below, when the shackle is in its locked position. When unlocked, the shackle will move upwardly until leg 251 clears housing 253 and the shackle is free to pivot around the longitudinal axis of leg 252 in the conventional manner. Housing extension 254 allows the limited movement required for leg 251 to clear the housing when in the unlocked position. Conventional means (not shown) holds leg 252 from moving completely out of housing extension 254.

Figure 28:
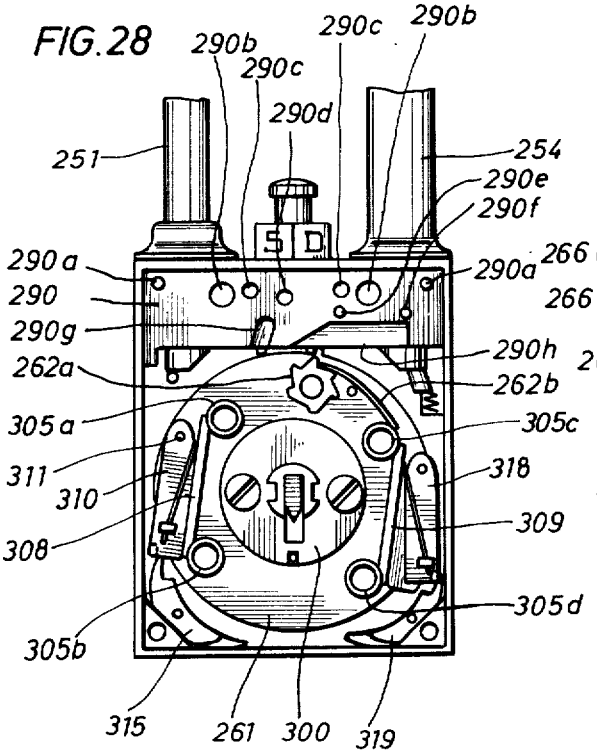
FIG. 28 is a view similar to FIG. 27 showing the rear plate of the tumbler moving assembly.
Figure 29:
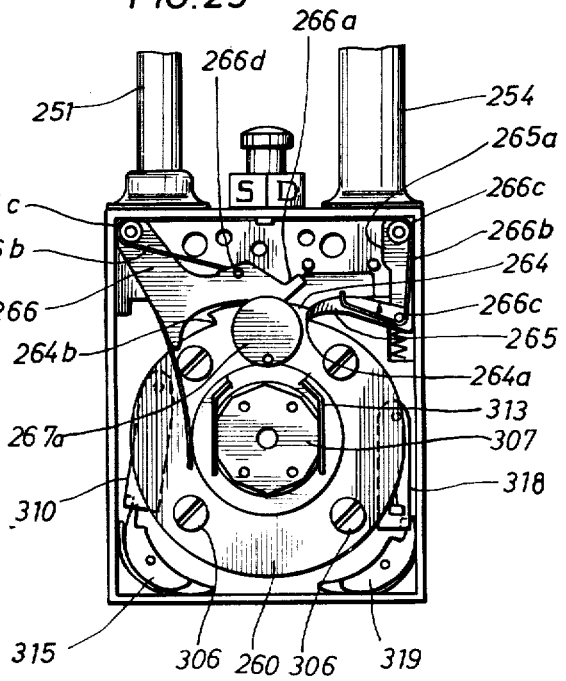
FIG. 29 is a view similar to FIGS. 27 and 28 showing the front plate of the tumbler moving assembly.
Figure 31:
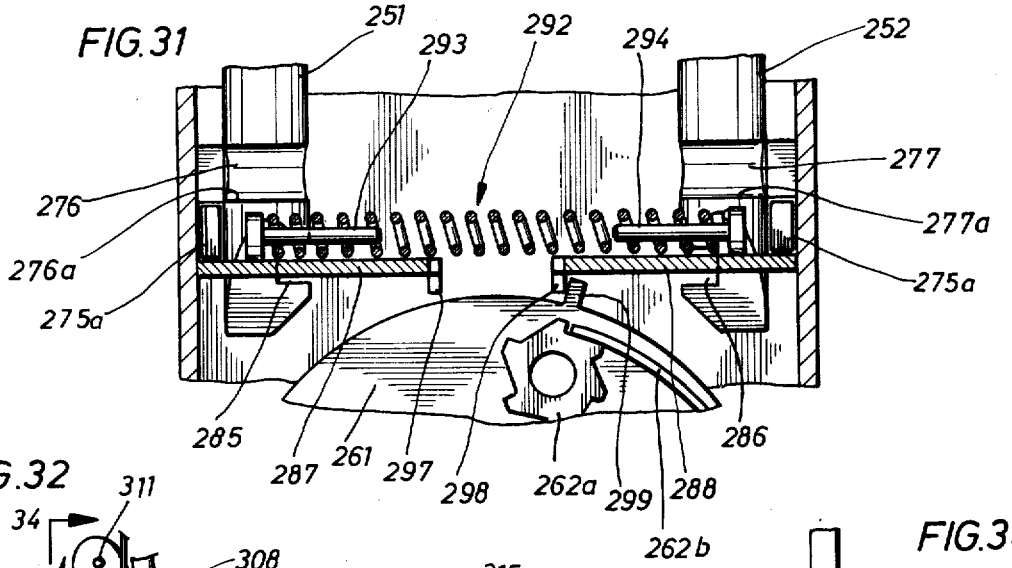
FIG. 31 is a cross-sectional view taken along line 31—31 of FIG. 30.
Figure 36:
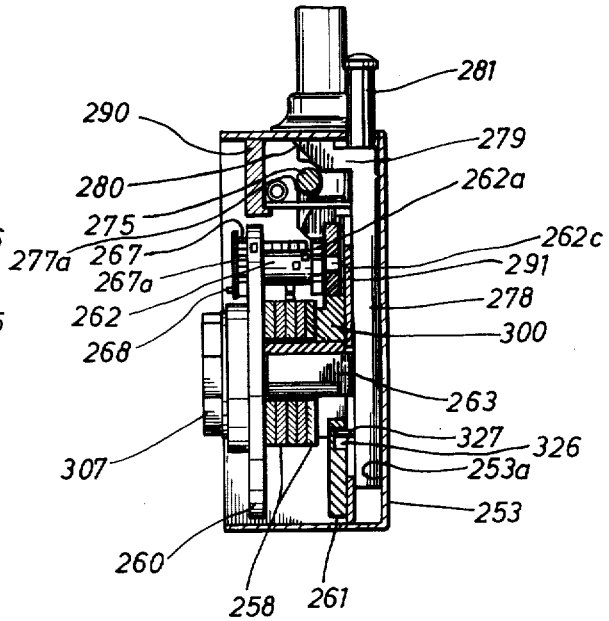
FIG. 36 is a sectional view taken along line 36—36 of FIG. 26.
Figure 37:
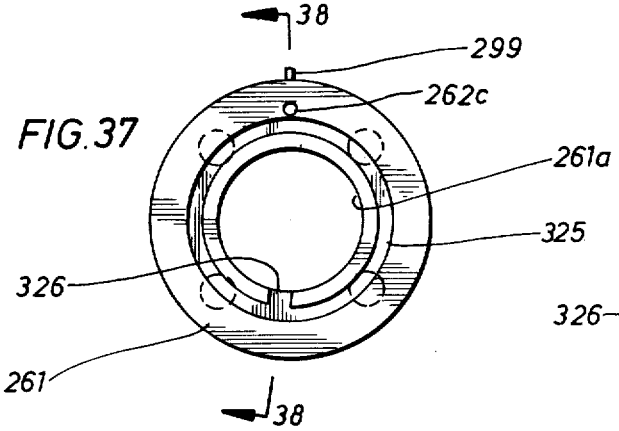
FIG. 37 is a rear view in elevation of the back plate of the tumbler moving assembly.
Figure 38:
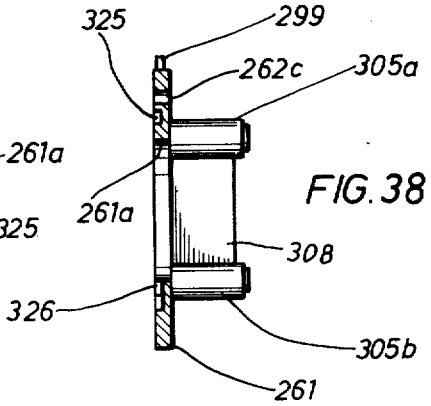
FIG. 38 is a view taken along line 38—38 of FIG. 37.

Mounting on the front of housing 253 is dial 255. Annular extending flange 256 supports the dial for rotation. The dial is provided with the usual numbers and marks so that the dial can be moved sequentially to position the proper combination numbers opposite index 257 on the annular flange. As in the embodiment shown in FIGS. 1–25, this embodiment of the lock includes a plurality of disc-shaped tumblers mounted in side-by-side relationship for rotation around a common axis. A plurality of such tumblers 258 is shown in FIG. 36 mounted for rotation around shaft 259. On opposite sides of the tumblers are disc 260 and 261. The discs are also mounted for rotation around the longitudinal axis of shaft 259 and support ratchet drum 262 for rotation with the discs around the axis of the shaft and also around its own longitudinal axis. The operation of the ratchet drum and the discs and the manner in which the rotation of the dial positions the tumblers to receive fence 263 will not be described in detail since this portion of the lock functions in exactly the same manner as the same portion did in the lock previously described. In other words, each time the dial is rotated back to zero, disc 260 has stop lug 264 that is engaged by pawl 265 and stopped in this position, as shown in FIG. 29. At the same time, pawl 266 has engaged ratchet 267 and moves the ratchet drum one position. As explained above, in each position of the ratchet drum it will engage one of the tumblers and move it into position for its gate to receive the fence of the lock, when the proper combination has been dialed. In one position, as explained above, the ratchet drum is in position to move or "sweep" all the tumblers to a preselected starting position from which the combination is then dialed. In this embodiment, holding ratchet 262*a* secured to the lower end of drum 262, as viewed in FIGS. 28, 31, and 36, is held against reverse rotation by sustaining pawl 262*b* shown in FIGS. 28 and 31, when lugs of the drum are moving the tumblers clockwise. Pawl 262*b* operates resiliently against ratchet 262*a* and is secured to disc 261 by means not shown. The end of drum 262 just below holding ratchet 262*a* is of small diameter and fits into lower bearing hole 262*c* in disc 261, as seen in FIGS. 36, 37, and 38.

Figure 26:
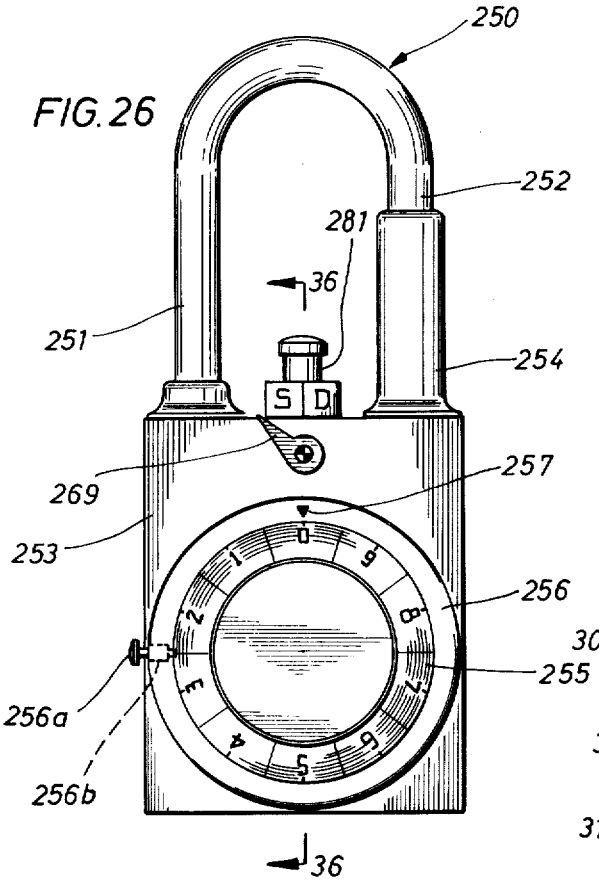
FIG. 26 is a front view in elevation of an alternate embodiment of the lock of this invention adpated for use as a pad lock.
Figure 27:
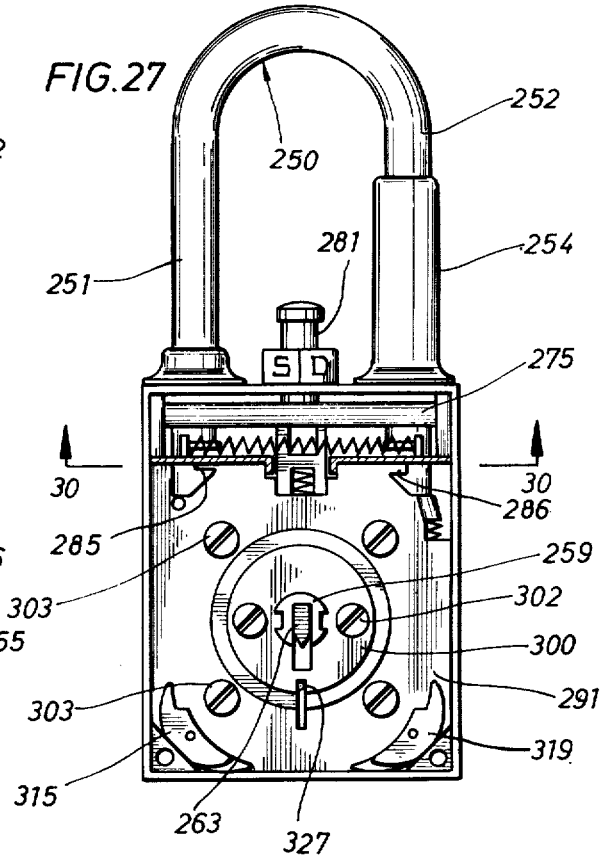
FIG. 27 is a view in elevation of the lock of FIG. 26 with the major portion of the lock mechanism removed including the tumbler wheel assembly.
Figure 39:
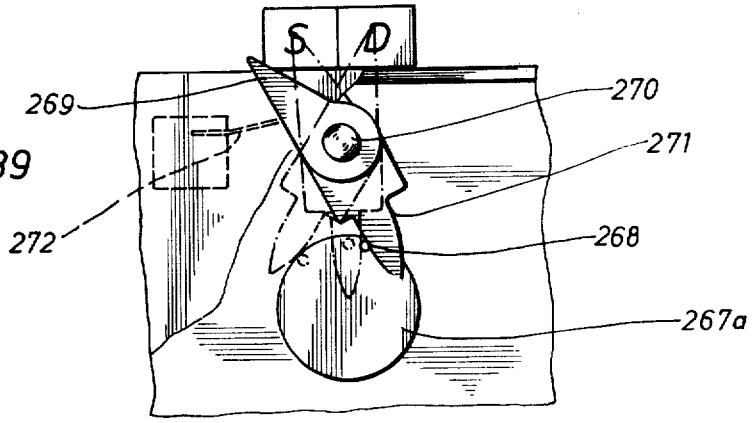
FIG. 39 is a view in elevation of the pointer for indicating the position of the ratchet wheel of the tumbler moving assembly.

In this connection, this embodiment of the invention employs a visual indication of the position of the ratchet drum. As shown in FIG. 39, ratchet 267 includes indicator actuating plate 267*a* which carries pin 268. Pointer 269 is mounted on shaft 270, which extends through the housing to support the pointer on the outside of the housing above the dial, as shown in FIG. 26. Mounted on shaft 270 on the inside of the housing is pointer actuating finger 271. Spring 272 is arranged to urge the finger to move the pointer to the solid line position in FIG. 39. When pointer 269 is in a position over the S shown on top of the housing of the lock, the ratchet drum is in position to move or "sweep" all the tumblers to a preselected starting position from which the combination is then dialed. When the dialed is rotated 360° to the right, notch 264*a* formed by stop lug 264 on disc 260 is engaged by pawl 265 which stops disc 260 at the position shown in FIG. 29. Pawl 265 is hinged for swinging with pawl swing arm 265*a*. The dial is then turned 360° counterclockwise to the ratchet position by allowing pawl 266 to drop downward and to the left, bringing projection 266*a* into position to catch one of the teeth on ratchet 267 on the underside of the indicator actuating plate 267a and pin 268 will move the pointer over the D mounted adjacent the S on the housing. This indicates that the ratchet drum is in position to begin the dialing of the combination. As the dial is turned to each number of the combination, ratchet drum 262 will engage one of the tumbler discs and move it into position for its gate to receive the fence of the lock when the proper combination has been dialed. When the dial is turned left 360° from the sweep position, as shown in FIG. 29, formed spring wire 266*b* fitting around pin hubs 266*c* urges pawl 266 downward and to the left as ratchet 267 follows the lower curve of pawl 266. To also assure such movement, stop pin 266d on the underside of pawl 266 rides the perimeter of disc 260 and rides into ratchet stop notch **264*b* thus assuring a precise stopping point when pawl 266 is pressed against the left side of the case. Formed spring 266*b* passes around the back sides of all three pin hubs 266*c* and hooks over the top edge of sweep stop pawl 265. Thus, sweep stop pawl 265 is urged inwardly to a normal position with its point also riding the perimeter of disc 260 until it rides into notch 264*a* and is pressed against the right side of the case for precise sweep stop position. When the first number is dialed, pin 268 will move out of engagement with finger 271 and the finger, due to the action of spring 272, will be moved to the solid line position shown in FIG. 39. It will stay there until the ratchet drum is again moved to the sweep position. Thus, an operator of the lock can look at pointer 269** and know whether the ratchet drum is in the sweep position, is ready to dial the combination, or is in neither position. If the latter is indicated, the ratchet drum can be stepped to the sweep position where the lock can be prepared for dialing the combination by sweeping the tumblers to the starting position.

Figure 35:
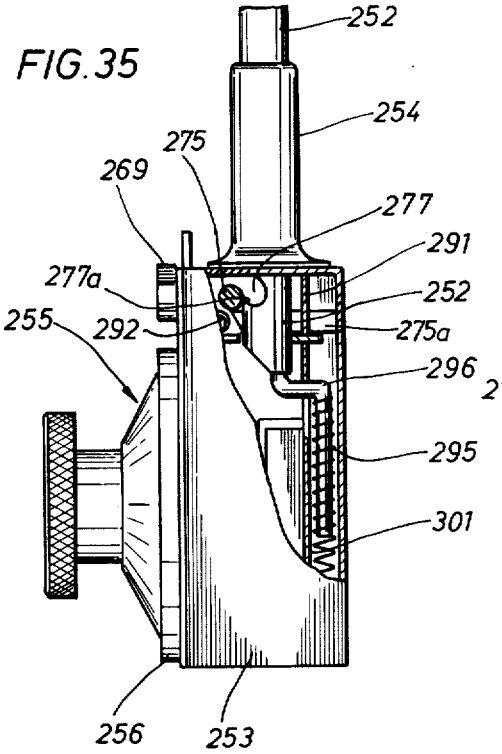
FIG. 35 is a side view of the lock of FIG. 26 with a portion of the housing broken away showing the bolt in its unlocked position.

Means are provided to hold the bolt, shackle 250 in this embodiment, in the locked position. In the embodiment shown, locking bar 275 extends transversely across legs 251 and 252 of the shackle and engages grooves 276 and 277 in the legs, respectively, to hold the shackle in the housing when the lock is in its locked position. Each groove has an overlapping lip, such as lip **277*a* as shown in FIG. 35, that forms a pocket to receive the locking bar. Spring 295** holds the bar in the pocket which keeps the locking bar from being jarred out of holding position.

The lock includes fence means that is movable between a first position in which the bolt or shackle is in its locked position and a second position moving the bolt holding means out of holding engagement to allow the bolt to move to the unlocked position. The fence means includes fence 263 which is attached to and carried by fence slide bar 278. On either side of fence slide bar 278 are spacer guide blocks (not shown and running the length of case 253) to which plate 291 is secured by screws 303. Said spacer guide blocks are in turn secured to the bottom of case 253 by means not shown. Locking bar cam member 279 is attached to the upper end of fence slide bar 278. The cam member has inclined surface 280 positioned to engage locking bar 275 and urge it out of engagement with grooves 276 and 277 in the legs of the shackle, when the fence slide bar is moved downwardly, as viewed in FIG. 35. Guides **275*a*, as shown in FIGS. 31 and 35,** hold the bar in position to move back into the grooves in the legs of the shackle when the shackle is returned to the locked position.

Plunger 281 has one end connected to fence slide bar 278 and extends out of housing 253 to allow manual operation of the fence means. A lost motion connection (not shown) is provided between plunger 281 and the fence slide bar so that when the gates of the tumblers are not in position to receive the fence and the slide bar cannot move downwardly, the plunger will be forced downwardly against resilient means which will yield without exerting undue pressure against the fence slide bar. When the proper combination has been dialed, downward movement of plunger 281 will move fence 263 into the aligned gates of the tumblers and inclined surface 280 will cam locking bar 275 out of holding engagement with the grooves in the ends of the legs of the shackle 250.

The shackle is now free to move out of the housing. In this embodiment, however, second and third bolt holding means are provided which require manipulation of the dial in order to finally open the lock even after the locking bar has been moved out of holding engagement with the shackle. One of the reasons that this is desirable is that is forces the operator of the lock to manipulate the dial one more time which moves the ratchet drum to the sweep position and sweeps the tumblers all back into position ready for the combination to be dialed again. This positions the tumblers so that fence 263 cannot again be moved downwardly after the lock is opened. This prevents someone from inadvertently pushing down on the plunger and manipulating the dial while the lock is open, which would change the combination of the lock.

Figure 30:
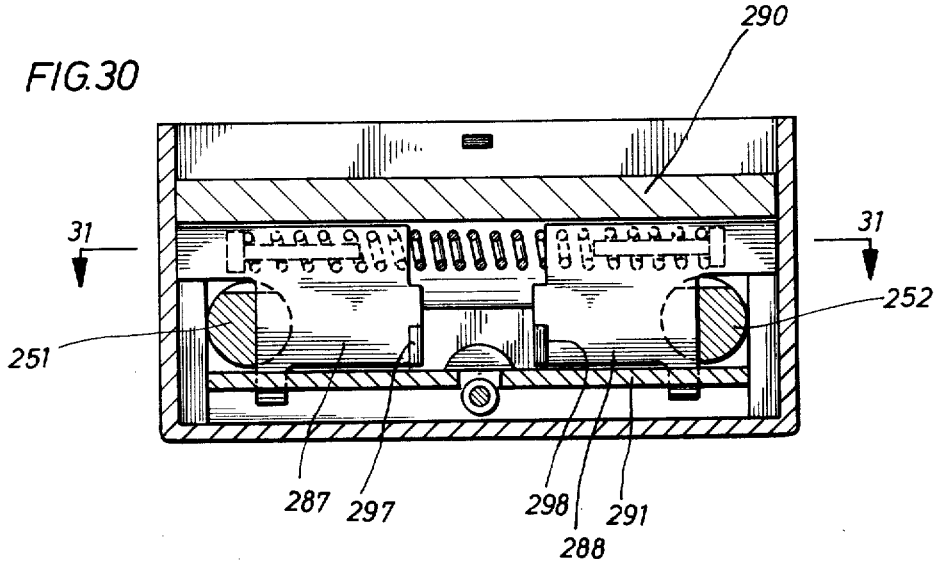
FIG. 30 is a sectional view on an enlarged scale of the secondary bolt holding means taken along lines 30—30 of FIG. 27.

Therefore, it is a feature of this embodiment of the invention to provide secondary shackle holding means that are released only when the dial has been manipulated in such a manner as to move the tumblers to the desired position before the lock can be opened. As shown in FIGS. 30 and 31, legs 251 and 252 of the shackle are provided with grooves 285 and 286, respectively. Positioned to engage these grooves are holding plates 287 and 288. These plates are in guide grooves provided by plates 290 and 291 located on opposite sides of the plates. The grooves guide the plates as they move transversely the longitudinal axis of the shackle legs.

Shelf plate 290, in addition to providing guide grooves, contains a series of openings. Openings **290*a* receive hub pins 266*c*. Opening 290*b* are clearance holes for the locking bar return springs. Openings 290*c* are the case hold down bolt holes. Opening 290*d* is a bearing hole for the indicator shaft 270. Opening 290*e* is to receive the limiter pin for the indicator finger. Opening 290*f* is a hole to receive the limit pin for swing arm 265*a*. Groove 290*g* is a clearance groove for stop pin 266*d*. Groove 290*h* is a clearance groove for pawl 265.**

Coil spring 292 extends over guide pins 293 and 294 attached to the holding plates to urge the plates apart and into position to engage grooves 285 and 286. The width of these grooves is greater than that of the plate, as can be seen in FIG. 31, so that the plates do not hold the shackle when the shackle is in the locked position and locking bar 275 is holding the shackle. When the locking bar has been moved out of engagement with the shackle by the fence means, spring 295, which exerts an upward force on leg 252 through bar 296, as shown in FIG. 35, will cause the shackle to move upwardly when it is released from the locking bar. This will cause plate 287 to engage the bottom side of groove 285 and prevent further upward movement of the shackle. At this time, plate 288 has not engaged the bottom side of its groove as there is still clearance between this plate and its groove when plate 287 is in engagement with its groove. The plates carry lugs 297 and 298 that are positioned to be engaged by lug 299 attached to disc 261 of the tumbler assembly.

In operation, after the combination has been dialed and the tumblers are positioned with their gates ready to receive the fence, downward movement of plunger 281 will move locking bar 275 out of holding engagement with the shackle. The shackle will move out of the housing due to the force of spring 295 until plate 287 engages the bottom side of groove 285. The next step in opening the lock is to turn the dial clockwise 360° from zero. This will sweep all of the tumblers back to dialing position. As this is done, lug 299 will engage lug 297 and move plate 287 to the right, as viewed in FIG. 31, until it is clear of groove 285 and out of holding engagement with the shackle. Spring 295 will continue to urge the shackle out of the housing and when plate 287 has been moved out of engagement, the shackle will move further out of the housing until plate 288 is in holding engagement with the bottom side of groove 286. The ratchet wheel at this time, as explained above, will be at the end of the sweep operation. The dial is then rotated 360° to the left back to zero, which will cause lug 299 to engage lug 298 on the plate and move it laterally out of engagement with groove 286 of the shackle. At this point, the shackle is free to move out of the housing and the lock is opened. Also, the tumblers have all been moved into position so that the lock, when again closed, will be ready for the combination to be dialed in the normal way.

As explained above, one of the reasons for requiring the additional rotation of the dial after the combination has been dialed and the locking bar moved out of holding engagement is to rearrange the tumblers so that the fence cannot reenter the gates thereof and cause, inadvertently or otherwise, the changing of the combination of the lock. On the other hand, when it is desired to change the combination of the lock, it is only necessary to dial the combination, push down on the plunger until the fence is moved into the gates of the tumblers and then proceed to move through the sweep position to the dial position. Then, by dialing the desired new combination while holding the fence in engagement with the tumbler gates, the outer rims will be moved in the manner described above in connection with the first embodiment.

In accordance with another feature of this invention, means are provided to insure that the dial is returned to zero at any time the dial is rotated close to that position and to insure that the dial is rotated the proper distance when sweeping the tumblers to the desired position for starting the dialing of the combination. As explained above, tumblers 258 are located in side-by-side relationship on shaft 259. The shaft is attached to hub 300, which is bolted to mounting plate 291 by mounting screws 302. The mounting plate is spaced from backwall 253*a* of the housing by appropriate spacers which are connected to the backwall and tapped to receive mounting screws 303. Disc 261, which supports one end of ratchet drum 262, is positioned to rotate on hub 300. It is connected to disc 260, which is located on the other side of the tumblers through spacers 305, four of which are provided, as shown in FIGS. 28 and 38. Machine screws 306 connect disc 260 to these spacers to assemble the two plates together for rotation by the dial. The dial is secured down to the top of hub 307 by a center machine screw and drive pins (not shown) that cause dial 255 and hub 307 to rotate as one, which, as explained above, carry the ratchet drum with them as they rotate, as shown in FIGS. 29 and 36. Mounting bar 308 extends between spacers 305*a* and 305*b*, as shown in FIG. 28. Mounting bar 309 extends between spacers 305*c* and 305*d*. Both mounting bars carry members that prevent rotation in the opposite direction after they have been rotated a predetermined distance in one direction and will prevent this rotation until they have been rotated through a predetermined angle, which is designed to insure that rotation of the dial back to zero and through the sweep operation is carried through sufficiently to properly ratchet the ratchet drum and to properly position the tumblers preparatory to dialing the combination.

Figure 32:
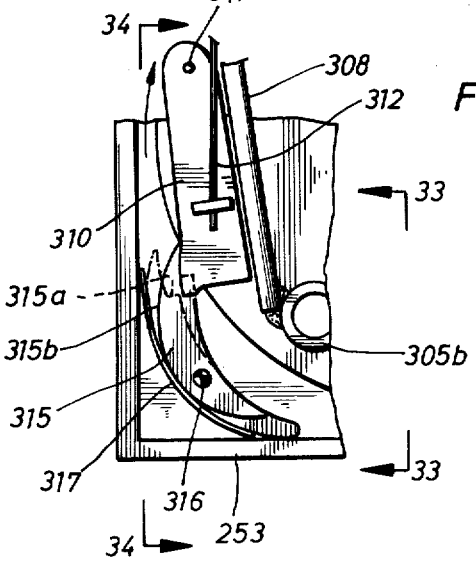
FIG. 32 is a view in elevation, on an enlarged scale, of the zero return apparatus of this embodiment.
Figure 33:
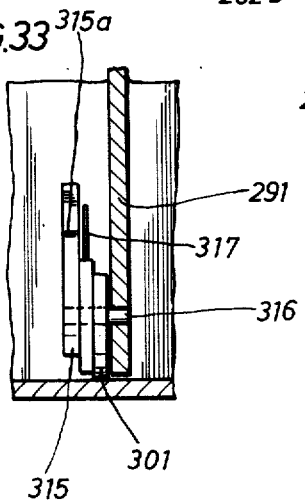
FIG. 33 is a view of the stop member of the apparatus of FIG. 32 taken along line 33—33 of FIG. 32.
Figure 34:
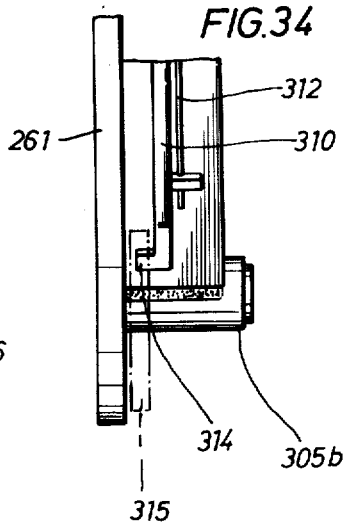
FIG. 34 is a view of the pawl member of the zero return apparatus taken along line 34—34 of FIG. 33.

In FIGS. 32, 33, and 34, the apparatus associated with mounting bar 308 is shown on an enlarged scale, including moving stop member 310 which is pivotally mounted on mounting bar 308 by pin 311 (FIG. 28). Spring 312 urges moving stop member 310 against mounting bar 308. The moving stop member has laterally extending stop lug 314 as shown in FIG. 34. Stationary stop member 315 is mounted for pivotal movement in the lower left hand corner of housing 253 by pin 316. The member is supported by pin 316 secured in spacer block 301. Spring 317 urges this stop member to the solid line position shown in FIG. 32. When in this position, shoulder 315*a* will engage lug 314 on the moving stop member, as shown in FIG. 32, and prevent counterclockwise rotation of the dial.

In operation, when rotating the dial in a clockwise direction, as for example when sweeping the tumblers preparatory to dialing the combination, as the operator approaches the end of the sweep operation, should he stop before lug 314 clears the upper end of stationary stop member 315, when he starts to come back in the counterclockwise direction, shoulder 315*a* will engage lug 314 and stop rotation altogether. This will tell him that he must continue rotating in a clockwise direction to complete the sweep operation at which time lug 314 will clear the upper end of stationary stop member 315. Then, when he returns in a counter-clockwise direction, side 315*b* of stop member 315 will engage lug 314 and force the lug to move along the back side of the stationary member. Thus, the return of the dial in the counter-clockwise direction can be continued without interruption.

Moving stop member 318, mounted on mounting bar 309, and stationary stop member 319 are located in the lower right hand corner and sits higher so as not to interfere with the apparatus of the lower left hand corner, however it functions in the same manner to insure that the dial is returned to zero after each dialing operation. As explained above, this is important to insure that pawl 266 moves ratchet 267 the desired distance to position the ratchet drum for the next operation.

In accordance with one of the features of this invention, means are provided to prevent the "feel" of the combination of the lock. Referring to FIGS. 37 and 38, disc 261 is shown in plan and sectional views. FIG. 37 is the back side of the plate, as viewed from the right in FIG. 36. It is provided with annular groove 325 and transverse groove or slot 326 that connects the groove with central opening 261*a* in the plate. Fence supporting slide bar 278 carries pin 327, shown in FIG. 36, which is positioned to extend into opening 261*a* of disc 261 during normal situations, i.e., when the fence is in its usual position and no pressure is being exerted on plunger 281. Should an attempt be made to exert pressure on the plunger to urge the fence against the tumblers to "feel" the combination, the slightest downward movement of the fence and the fence slide bar due to pressure exerted on the plunger will move pin 327 downwardly so that it will engage slot 326. Of course, the slot may not be directly under the pin at the time, but as the dial is rotated slot 326 will eventually be brought under pin 327 and it will move into the slot and in this position prevent any further rotation of the dial. Thus, any attempt to feel the combination of the lock will be prevented by pin 327. When the proper combination has been dialed and the plunger moved downwardly, pin 327 will move through slot 326 as the fence moves into the gates of the tumbler and position itself in annular groove 325. In this position, there will be free rotation of the dial without any interference from this pin. This would be required, of course, during the changing of the combination in the manner explained above. Also, for the pin to move through the slot, the dial must be returned counterclockwise to zero to properly position the slot. This insures that the ratchet drum is moved to the sweep position after the last number is dialed.

In this embodiment, resilient U-shaped spring 313, the legs of which are shown in FIG. 29, is attached to the housing and positioned for the legs to grip two opposite sides of ten sided hub 307, which is a part of disc 260 protruding through the case top sufficiently for mounting of dial 255 thereupon. When zero of the dial is positioned at index 257, the two legs of the U-shaped spring are in parallel alignment with two opposite sides of hub 307. Each exerts sufficient inward pressure to urge the hub and dial to settle into and maintain that position. Then, as the dial is turned clockwise and as successive digits of the dial are positioned at index 257, the two resilient legs of the U-shaped spring cooperate with each successive pair of opposite flats of hub 307 to settle in and maintain each position thus achieved. Thus, by counting off such positions by "feel" as the dial is turned to each digit of the combination, the lock can be opened by a blind user or in total darkness. Half graduation pin **256*a*, as shown in FIG. 26, is in alignment with ten locating holes circumferentially spaced equal distances around the skirt of dial 255 and is held in its out of engagment position by a small compression spring (not shown) bearing against the head of the pin and the bottom of spring well 256*b*. If half numbers are desired in your combination, for example 1, 2, 3, 4, 5½, the U-wire 313 will settle the dial at the whole numbers. However, when the dial arrives at 5, if it is dark and one could not see the 5½ mark, a light finger pressure is exerted against pin head 256*a* while the dial is turned further until pin 256*a*** drops into the provided hole in the skirt of the dial and stops rotation at 5½, after which the dial is returned left to the zero ratchet stop. This provides a further positive means for users to locate half stations without watching the dial.

Use of the master combination starting point pin in this embodiment functions internally the same as is described in the first embodiment. However, in the padlock version, a pin is manually inserted through an opening (not shown) in the back of the housing and held there with a light inward finger pressure as the dial is slowly turned clockwise from the starting point. As in the first embodiment, each time the pin is felt to drop into the tumbler pin hole, the dial is returned counterclockwise to ratchet stop so the drum lug can pick up the next tumbler, which process is repeated as many times as there are digits in the combination, at which time the external indicator should point to position S. In this embodiment, no special pin is required as any fairly stiff wire, safety pin or hair pin will suffice for the purpose. After sweeping the dial and pulling the pin, the external indicator will now be at the D or dial position and the master combination can then be used to open the lock.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is comtemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A combination lock comprising a bolt movable between a locked and an unlocked position, fence means including a fence, said fence means being movable between a first position holding the bolt in the locked position and a second position releasing the bolt for movement to the unlocked position, a plurality of disc-shaped tumblers mounted in side-by-side relationship for rotation around a common axis, each tumbler having a protrusion on its periphery and a gate to receive the fencer when the tumbler is in a preselected position, a rotatable dial with a circular, graduated face, means mounting the dial for rotation around an axis perpendicular to the face, a ratchet drum extending across the tumblers and movable by the dial along the outer periphery of the tumblers as the dial is rotated, a plurality of pairs of lugs spaced longitudinally along the ratchet drum with each pair in alignment with one of the tumblers, each pair having one lug in alignment along the drum with one lug of all of the other pairs so that in one position of the ratchet drum one lug of each pair will engage the protrusions and all tumblers will be rotated with the dial to allow the rotation of the dial to bring all tumblers to a predetermined relative position, said other lug of each pair being spaced circumferentially around the ratchet drum different distances from the first lug, means to rotate the ratchet drum on its axis each time the dial is moved in one direction back to a preselected position to position the lugs with the first lug of each pair in position to engage the tumbler with which it is aligned to allow the tumblers to be rotated to said preselected relative position and to successively rotate each tumbler individually to allow the gates of the tumblers to be positioned to receive the fence of the fence means and allow the fence means to move to its second position and release the bolt.

2. The lock of claim 1 further provided with means for indicating when the ratchet drum is positioned to move all of the tumblers to said preselected position.

3. The lock of claim 2 in which the indicating means is an audible signal.

4. The lock of claim 1 in which each tumbler includes a rim made of resilient material mounted on a hub, said rim being split radially and expanded when installed to clamp the hub sufficiently for the hub to rotate with the rim, a lever located in the split of the rim to be engaged by the lugs on the ratchet drum to rotate the rim and the hub and to expand the rim when the hub is held against rotation to reduce the clamping force of the rim on the hub to allow the rim to rotate relative to the hub when the hub is held against rotation.

5. The lock in claim 1 further provided with a housing and in which the bolt is a U-shaped shackel having the end portions of the legs thereof extending into the housing when the shackle is in its locked position and with at least one leg outside the housing when the shackle is in its unlocked position.

6. The lock of claim 5 in which the fence means includes a locking bar for engaging the shackle to hold the shackle in its locked position, a plunger assembly having a plunger extending outside of the housing for manual operation and a locking bar release member movable by the plunger to force the locking bar out of holding engagement with the shackle when the gates of the tumblers are positioned to receive the fence.

7. The lock of claim 6 further provided with means for holding the shackle from moving to its unlocked position when the locking bar has been moved out of holding engagement until the tumblers have been returned to said predetermined relative position with the gates out of position to receive the fence.

8. The lock of claim 1 in which each tumbler includes a rim and a hub, the rim being releasably held against rotation relative to the hub by friction, and in which the lock is further provided with means to open the lock with a master combination, said means including a hole in the hub of each tumbler with each hole spaced equally from the axis of rotation of the tumbler, a rod for moving through the holes to position the tumblers with their holes in alignment and to hold the hubs while the rims are being moved to a predetermined position to allow the lock to be opened with a known master combination.

9. The lock of claim 8 further provided with a plurality of spacer discs each located between adjacent tumblers, means holding the spacer discs from rotation with the tumblers so that the rotation of one tumbler will not influence adjacent tumblers, said discs being provided with openings through which the master combination rod may extend to be supported by the spacer discs.

10. The lock of claim 9 further provided with a knob, means mounting the knob for rotation and for movement along its axis of rotation, means connecting the knob to the bolt for moving the bolt between its locked and unlocked positions by rotating the knob, and means for releasing the bolt from the fence means when the knob is moved axially to allow the bolt to be moved to an unlocked position without moving the fence means to said second position.

11. The lock of claim 10 further provided with means for releasably holding the bolt in the locked position and means for releasably holding the bolt in its unlocked position.

12. A combination lock comprising a plurality of tumblers, each tumbler including a hub having a slot therein and a split rim mounted in frictional engagement therewith, fence means for movement into the slot of each tumbler when they are positioned in a preselected position to unlock the lock, means for mounting the tumblers for individual movement to said preselected relative position to open the lock, means for moving the tumblers for individual movement to said preselected position to open the lock including a plurality of tumbler engaging members, means mounting the members for movement to a plurality of positions and means for moving the members to a plurality of positions with one of said members being located in each position to engage one of the tumblers and move it with the member, means to move the member mounting means to each of said positions to sequentially move the tumbler engaging members into tumbler engaging position, means for moving each tumbler engaging member when in tumbler engaging position to move the tumbler it engages to its preselected position to allow the lock to be opened, and means for holding the hub of each tumbler from rotation with the rim as the tumbler engaging members move each rim to a new position on the hub to change the combination of the lock.

13. A combination lock comprising a housing, a U-shaped bolt having its legs extending into the housing when in its locked position and having one end clear of the housing when in its unlocked position, means holding the bolt in its locked position, fence means including a fence, said fence means being movable between a first position in which the bolt is in its locked position and a second position moving the bolt holding means out of holding engagement to allow the bolt to move to the unlocked position, a plurality of disc-shaped tumblers mounted in side-by-side relationship for rotation around a common axis, each tumbler having a protrusion on its periphery and a gate to receive the fence when the tumbler is in a preselected position, a rotatable dial with a circular, graduated face, means mounting the dial for rotation around an axis perpendicular to the face, a ratchet drum extending across the tumblers and movable by the dial along the outer periphery of the tumblers as the dial is rotated, a plurality of pairs of lugs spaced longitudinally along the ratchet drum with each pair in alignment with one of the tumblers, each pair having one lug in alignment along the drum with one lug of all of the other pairs so that in one position of the ratchet drum one lug of each pair will engage the protrusions and all tumblers will be rotated with the dial to allow the rotation of the dial to bring all tumblers to a predetermined relative predialing position, said other lug of each pair being spaced circumferentially around the ratchet drum different distances from the first lug, means to rotate the ratchet drum on its axis each time the dial is moved in one direction back to a preselected position to position the lugs with the first lug of each pair in position to engage the tumbler with which it is aligned to allow the tumblers to be rotated to said preselected relative predialing position and then successively rotate each tumbler individually in accordance with the combination of the lock to allow the gates of the tumblers to be positioned to receive the fence of the fence means and allow the fence means to move to its second position and move the bolt holding means out of holding engagement with the bolt.

14. The lock of claim 13 in which each tumbler includes a hub in which the gate is located to receive the fence and a rim of resilient material mounted on the hub, said rim being split radially and having an opening such that when installed on the hub the rim will clamp the hub with sufficient force to prevent rotation relative to the hub to cause the hub to rotate with the rim while dialing the combination and will allow relative roation when the rim is rotated by the dial while the fence is in engagement with the gate to allow the combination to be changed for opening the lock.

15. The lock of claim 14 further provided with secondary means for holding the bolt in the housing after the bolt holding means has been moved out of holding engagement and means carried by the dial to release the secondary holding means when the dial has rotated the tumblers back to said preselected predialing position to prevent the combination from being changed accidentally while the lock is open by holding the fence in the gates of the tumblers while manipulating the dial.

16. The lock of claim 15 in which the secondary holding means includes a holding plate, resilient means holding the plate in a groove in a leg of the bolt to engage a side of the groove and hold the bolt from moving to its unlocked position, and means carried by the dial for moving the plate out of engagement with the shoulder to release the bolt when the dial has rearranged the tumblers to move the gates out of fence receiving position.

17. The lock of claim 16 further provided with a second bolt holding plate, resilient means holding the second plate in engagement with a groove in the other leg of the bolt to engage a side of the groove and hold the bolt from moving to its unlocked position, means carried by the dial to move the second holding means out of holding engagement when the dial has moved all tumblers to the predialing position and in which the first plate is moved out of holding position when the dial is returned to rotate the ratchet drum into position to begin dialing the combination.

18. The lock of claim 13 further provided with means for preventing return rotation of the dial in either direction after the dial has been rotated in either direction through a preselected angle until the dial has been moved to the end of its rotation in said direction to insure that the tumblers are moved to the desired predialing position when the dial is rotated in one direction and that the ratchet drum is moved to the next position when the dial is returned to the preselected position for moving the drum.

19. The lock of claim 13 in which the bolt holding means comprises an elongated bar and each leg of the bolt has a groove to receive the bar when in its locked position, each groove having a pocket to receive the bar with a lip extending over the bar when in the pocket to prevent the bar from moving laterally out of the groove, and resilient means urging the bolt toward its unlocked position to resiliently hold the bar in the pocket to prevent the bar from being jarred out of the pockets to open the lock.

20. The lock of claim 13 in which the bolt holding means includes a locking bar for engaging the bolt to hold the bolt in its locked position, a plunger assembly having a plunger extending outside of the housing for manual operation and a locking bar release member movable by the plunger to force the locking bar out of holding engagement with the bolt when the gates of the tumblers are positioned to receive the fence.

21. The lock of claim 20 further provided with means to hold the dial from rotation when the fence is moved toward the tumblers before the combination is dialed to thereby prevent any feeling out of the combination.

22. The lock of claim 13 further provided with a dial having a polyhedron-shaped member with a side for each position of the dial and resilient means for engaging one of the sides in each position to resist movement of the dial to the next position sufficiently for the number of positions through which the dial is rotated can be felt and counted and on which the resilient means urges the dial to a proper orientation in each position.

23. The lock of claim 22 in which the dial is further provided with manually operated stop means to position the dial between the position urged by the resilient means and the polyhedron-shaped member to increase the number of combination numbers available for opening the lock.

24. As a sumcombination, a tumbler for a combination lock comprising a hub for mounting on a shaft and a rim mounted on the hub, said rim being split and having an opening smaller than the diameter of the hub to cause the rim to grip the hub with a resilient force when mounted thereon, and an L-shaped member located in the split and having one leg protruding beyond the rim to be engaged by tumbler moving means and the other leg extending in the opposite direction of movement so that a force exerted on the protruding leg will cause the second leg to pry the rim away from the hub and reduce the force required to move the rim on the hub when changing the combination of the lock.

* * * * *